US005418102A

United States Patent [19]

Kotaki et al.

[11] Patent Number: 5,418,102

[45] Date of Patent: May 23, 1995

[54] DEVELOPER FOR DEVELOPING ELECTROSTATIC IMAGE, IMAGE FORMING METHOD, TONER IMAGER FIXING METHOD AND IMAGE FORMING APPARATUS

[75] Inventors: Takaaki Kotaki, Yokohama; Yoshihiko Hyosu, Machida; Ryoichi Fujita, Kawasaki; Makoto Kanbayashi, Yokohama; Minoru Shimojo, Tokyo, all of Japan

[73] Assignee: Canon Kabushiki Kaisha, Tokyo, Japan

[21] Appl. No.: 799,193

[22] Filed: Nov. 27, 1991

[30] Foreign Application Priority Data

| | | | |
|---|---|---|---|
| Nov. 29, 1990 | [JP] | Japan | 2-325525 |
| Nov. 29, 1990 | [JP] | Japan | 2-325526 |
| Nov. 29, 1990 | [JP] | Japan | 2-325527 |
| Nov. 29, 1990 | [JP] | Japan | 2-325528 |
| Nov. 29, 1990 | [JP] | Japan | 2-325529 |
| Nov. 29, 1990 | [JP] | Japan | 2-325530 |
| Nov. 30, 1990 | [JP] | Japan | 2-329628 |
| Nov. 30, 1990 | [JP] | Japan | 2-329630 |
| Jan. 29, 1991 | [JP] | Japan | 3-026699 |

[51] Int. Cl.[6] ..... G03G 9/00

[52] U.S. Cl. ..... 430/109

[58] Field of Search ..... 430/106, 109, 110, 111, 430/137, 904, 106.6; 525/299, 314; 522/57

[56] References Cited

U.S. PATENT DOCUMENTS

| | | | |
|---|---|---|---|
| 2,297,691 | 10/1942 | Carlson | 430/55 |
| 3,967,962 | 7/1976 | O'Malley | 430/120 |
| 4,083,895 | 4/1978 | Nnadi et al. | 525/385 |
| 4,269,937 | 5/1981 | Asanuma et al. | 430/538 |
| 4,306,166 | 12/1981 | Quandt | 310/90 |
| 4,557,991 | 12/1985 | Takasiwa et al. | 430/106.6 |
| 4,584,346 | 4/1986 | Kitchen | 525/314 |
| 4,917,982 | 4/1990 | Tomono et al. | 430/99 |
| 4,921,771 | 5/1990 | Tomono et al. | 430/110 |
| 4,925,765 | 5/1990 | Madeleine | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |

FOREIGN PATENT DOCUMENTS

| | | | |
|---|---|---|---|
| 0296850 | 12/1988 | European Pat. Off. . | |
| 42-23910 | 11/1967 | Japan . | |
| 43-24748 | 10/1968 | Japan . | |
| 46-5782 | 12/1971 | Japan . | |
| 48-47345 | 7/1973 | Japan . | |
| 48-47346 | 7/1973 | Japan . | |
| 523305 | 7/1973 | Japan . | |
| 52-3304 | 1/1977 | Japan . | |
| 56-158340 | 12/1981 | Japan . | |
| 57-6585 | 5/1982 | Japan . | |
| 57-52574 | 11/1982 | Japan . | |
| 58-14148 | 1/1983 | Japan . | |
| 58-8505 | 2/1983 | Japan . | |
| 58-72948 | 5/1983 | Japan . | |
| 58-86558 | 5/1983 | Japan . | |
| 58-203453 | 11/1983 | Japan . | |
| 59-88748 | 5/1984 | Japan . | |
| 59-174855 | 10/1984 | Japan . | |
| 59-174856 | 10/1984 | Japan . | |
| 59-226358 | 12/1984 | Japan . | |
| 60-2411 | 1/1985 | Japan . | |
| 60-45259 | 3/1985 | Japan . | |
| 60-45261 | 3/1985 | Japan . | |
| 60-46566 | 3/1985 | Japan . | |
| 60-123855 | 7/1985 | Japan . | |
| 62-47649 | 3/1987 | Japan . | |
| 64-024879 | 1/1989 | Japan | 522/57 |
| 1295269 | 11/1989 | Japan . | |

*Primary Examiner*—Marion E. McCamish
*Assistant Examiner*—Laura Weiner
*Attorney, Agent, or Firm*—Fitzpatrick, Cella, Harper & Scinto

[57] ABSTRACT

A developer for developing an electrostatic image has a toner containing a binder resin and a colorant. The binder resin is comprised of an AB-type block copolymer having segment-A and segment-B.

The segment-A has a copolymer structure comprised of a styrene monomer and at least one monomer selected from the group consisting of an acrylic monomer, a methacrylic monomer and a diene monomer, and the segment-B has a copolymer structure comprised of a styrene monomer and at least one monomer selected from the group consisting of an acrylic monomer, a methacrylic monomer and a diene monomer, provided that the segment-A and segment-B have copolymer structures different from each other.

52 Claims, 3 Drawing Sheets

DEVELOPER FOR DEVELOPING ELECTROSTATIC IMAGE, IMAGE FORMING METHOD, TONER IMAGER FIXING METHOD AND IMAGE FORMING APPARATUS

BACKGROUND OF THE INVENTION

1. Field of the invention

The present invention relates to a developer for developing an electrostatic image, used in a process by which an electrostatic image is developed to form an image, Such as electrophotography, electrostatic recording or electrostatic printing. It also relates an image forming method, a toner image fixing method and an image forming apparatus that make use of the developer.

2. Related Background Art

A number of methods as disclosed in U.S. Pat. No. 2,297,691, Japanese Patent Publications No. 42-23910 and No. 43-24748 and so forth are conventionally known for electrophotography. In general, copies are obtained by forming an electrostatic latent image on a photosensitive member by utilizing a photoconductive material and by various means, subsequently developing the latent image by the use of a toner, and transferring the toner image to a transfer medium such as paper if necessary, followed by fixing by the action of heat, pressure or solvent vapor.

Various met hods or techniques have been developed in relation to the above final step, i.e., the step of fixing the toner image to a sheet such as paper. A method must commonly available at present is the pressure heating system making use of a heating roller.

The pressure heating system making use of a heating roller is e method of carrying out fixing by causing an image-receiving sheet to pass over a heating roller whole surface is formed of a material having a releasability to toner while a toner image surface of the former is brought into contact with the surface of the latter under application of a pressure. Since in this method the surface of the heating roller comes into contact with the toner image of the image-receiving sheet under application of a pressure, a very good thermal efficiency can be achieved when the toner image is melt-adhered onto the image-receiving sheet, so that fixing can be carried out rapidly. This method is therefore very effective in high-speed electrophotographic copying machines. In this method, however, since the surface of the heating roller comes into contact with the toner image under application of a pressure, part of the toner image may sometimes adhere and transfer to the surface of the fixing roller, which may re-transfer to the subsequent image-receiving sheet to cause an offset phenomenon, resulting in a contamination of the image-receiving sheet. Thus, it is essential in the heating roller fixing system that no toner is adhered to the surface of the heat fixing roller.

Accordingly, under existing circumstances, it is sought to provide a binder resin for toner, having a broad fixing temperature range and high anti-offset properties.

Research has been conducted on two-color copying machines or full-color copying machines, and many of which have been put into practical use. For example, Journal of Electrophotographic Society, Vol. 22, No. 1 (1983) and Journal of Electrophotographic Society, Vol. 25, No. 1, p. 52 (1986) issued reports on color reproduction and gradation reproduction.

However, images formed by full-color electrophotography presently put into practical use are not necessarily satisfactory to those who have become accustomed to seeing color images that are not directly compared with actual things or objects as in television pictures, photographs and color gravures or that are made artificially more beautiful than actual things.

In the full-color electrophotography, development is carried out plural times using plural kinds of toners with different colors, and toner layers are superposed on the same support to form a full-color image. For this reason, binder resins used for color toners are required to satisfy conditions as itemized below.

(1) Fixed toner must be brought into an almost perfectly molten state such that the form of toner particles can not be distinguished, in order that the fixed toner does not cause irregular reflection of light to hinder color reproduction.

(2) Since the toner layers are superposed, the binder resin must be transparent so that a different color tone in a lower toner layer has is not affected.

As stated above, when used in monochrome copying machines, binder resins used for toner are required to give a broad fixing temperature range and high anti-offset properties. When used in full-color copying machines, binder resins are required not only to have a broad fixing temperature range but also to be transparent and to give a flat image surface when images are fixed.

In recent years, in the field ranging from monochrome copying machines to full-color copying machines, variety is also required, e.g., to take copies at higher speed, to shorten the heat-up time of the heating roller and to decrease power consumption.

In order to satisfy these requirements, it is necessary to provide a binder resin for a toner that permits low-temperature fixing, and also, as stated above, which provides a broad fixing temperature range, has an excellent transparency, and can provide a flat image surface when images are fixed.

Meanwhile, one can consider a method making use of pressure fixing toners. In this method, the binder resin can not melt when the toners are used as toners for full colors in which three or four colors are superposed to effect color reproduction, so that color-mixing performance becomes poor to give a dull, chroma-poor image. Hence, in the fixing step, heat must be applied to the extent that the binder resin can melt and achieve color mixture.

Only for the purpose of achieving low-temperature fixing, it is possible to decrease melt viscosity of binder resins for toners. For example, there is a method in which the molecular weight of resin or the glass transition point thereof is lowered. This method, however, may result in a poor storage stability of toner which tends to cause phenomena such as blocking between toners and melt-adhesion of toner to a developing drum.

Hitherto, for the purpose of expanding the fixing temperature range of vinyl polymers, methods in which an anti-offset agent is used are disclosed in Japanese Patent Applications Laid-open No. 58-14148, No. 58-72948, No. 59-174855, No. 59-174856 and No. 60-123855, and Japanese Patent Publications No. 52-3304, No. 52-3305, No. 55-52574 and No. 58-8505. These, however, are supplementary means, and may damage the transparency of the toner when applied to monochrome toners or may bring about a poor color mixing performance when applied to full-color toners.

Japanese Patent Applications Laid-open No. 56-158340, No. 58-86558, No. 58-203453, No. 59-88748, No. 59-226358, No. 60-45259, No. 60-45261 and No. 60-46566 and Japanese Patent Publication No. 60-2411 disclose binder resins for a toner that have a low-molecular weight component and a high-molecular weight component. Use of such resins has made it possible to expand the fixing temperature range to a certain extent, but, on the other hand, causes the problem that grindability is lowered or melt viscosity becomes excessively high at the time of heat kneading, because of the presence of high-molecular weight components such as gels. Particularly when such binders are used in full-color toners, a problem arises in that the smoothness of image surfaces when images are fixed is damaged, resulting in a poor color mixing performance.

U.S. Pat. No. 4,925,765 discloses a negative solid block toner wherein an AB type, BAB type or ABA type block copolymer is used as a charge control agent.

In this block copolymer, a copolymer comprising acrylic monomers or a copolymer comprising methacrylic monomers is used as segment-A and a copolymer comprising monomers selected from the group consisting of styrene, a substituted styrene, butadiene, and an acrylate and/or a methacrylate as segment-B.

It can be presumed that use of such a block copolymer as a binder resin for a toner causes the problems that the grindability in the preparation of the toner becomes poor which makes particle size distribution broad and also the environmental stability of toner becomes poor, because of the segment-A which is an acrylic copolymer or methacrylic copolymer.

Thus, it is very difficult to satisfy at the same time fixing at a low temperature, to expand the fixing temperature range and to maintain the properties of toner, i.e., storage stability, fluidity, durability, transparency, and smoothness of fixed-image surface.

SUMMARY OF THE INVENTION

An object of the present invention is to provide a developer for developing an electrostatic image, having solved the above problems; and an image forming method, a toner image fixing method and an image forming apparatus that make use of such a developer.

Another object of the present invention is to provide a developer for developing an electrostatic image, capable of achieving low-temperature fixing and having a broad fixing temperature range; and an image forming method, a toner image fixing method and an image forming apparatus that make use of such a developer.

Still another object of the present invention is to provide a developer for developing an electrostatic image, having a good storage stability and fluidity, causing no agglomeration and also having an excellent impact resistance; and an image forming method, a toner image fixing method and an image forming apparatus that make use of such a developer.

A further object of the present invention is to provide a developer for developing an electrostatic image, having good static charge characteristics, having an always stable chargeability during its use and capable of giving a sharp and fog-free image; and an image forming method, a toner image fixing method and an image forming apparatus that make use of such a developer.

A still further object of the present invention is to provide a developer for developing an electrostatic image, capable of forming a fixed-image surface so as for the fixed toner not to cause irregular reflection of light to hinder color reproduction, when used as a full-color toner; and an image forming method, a toner image fixing method and an image forming apparatus that make use of such a developer.

A still further object of the present invention is to provide a developer for developing an electrostatic image, having color-mixing properties that do not affect a lower toner layer having a different color tone, when used as a full-color toner; and an image forming method, a toner image fixing method and an image forming apparatus that make use of such a developer.

The objects of the present invention can be achieved by a developer for developing an electrostatic image, comprising;

a toner containing a binder resin and a colorant, said binder resin being comprised of an AB-type block copolymer having segment-A and segment-B;

said segment-A having a copolymer structure comprised of a styrene monomer and at least one monomer selected from the group consisting of an acrylic monomer, a methacrylic monomer and a diene monomer, and said segment-B having a copolymer structure comprised of a styrene monomer and at least one monomer selected from the group consisting of an acrylic monomer, a methacrylic monomer and a diene monomer, provided that said segment-A and segment-B have copolymer structures different from each other.

The objects of the present invention can also be achieved by a method of forming an image by a process comprising the steps of;

bringing a charging member to which a voltage has been externally applied, into contact with a latent image bearing member to statically charge the latent image bearing member, said charging member having a conductive rubber layer and a release film formed at least at a portion of said conductive rubber layer coming into contact with said latent image bearing member;

forming an electrostatic latent image on the latent image bearing member having been statically charged; and developing said latent image using a developer to form a toner image; said developer comprising a toner containing a binder resin and a colorant, said binder resin being comprised of an AB-type block copolymer having segment-A and segment-B; said segment-A having a copolymer structure comprised of a styrene monomer and at least one monomer selected from the group consisting of an acrylic monomer, a methacrylic monomer and a diene monomer, and said segment-B having a copolymer structure comprised of a styrene monomer and at least one monomer selected from the group consisting of an acrylic monomer, a methacrylic monomer and a diene monomer, provided that said segment-A and segment-B have copolymer structures different from each other;

transferring the developed toner image to a transfer medium from said latent image bearing member; and cleaning the surface of said latent image bearing member to remove toner remaining untransferred.

The objects of the present invention can also be achieved by a toner image fixing method comprising passing a transfer medium having beared a toner image, between a pair of rollers opposingly brought into pressure contact each other at least one of which is coated with a release agent, to fix said toner image to said transfer medium, wherein;

said developer for froming said toner image comprises a toner containing a binder resin and a colorant, said binder resin being comprised of an AB-type block copolymer having segment-A and segment-B; said segment-A having a copolymer structure comprised of a styrene monomer and at least one monomer selected from the group consisting of an acrylic monomer, a methacrylic monomer and a diene monomer, and said segment-B having a copolymer structure comprised of a styrene monomer and at least one monomer selected from the group consisting of an acrylic monomer, a methacrylic monomer and a diene monomer, provided that said segment-A and segment-B have copolymer structures different from each other; and at least one of said pair of rollers opposingly brought into pressure contact comprises a roller substrate, an elastic layer provided on said roller substrate, an oil-resistant layer provided on said elastic layer and an anti-offset layer provided on, said oil-resistant layer; these layers having an elongation that is larger by degrees in order of the anti-offset layer, the oil-resistant layer and the elastic layer.

The objects of the present invention can also be achieved by an image forming apparatus comprising;

a latent image bearing member capable of bearing an electrostatic latent image;

a charging;means for statically charging said latent image bearing member;

a latent image forming means for forming an electrostatic latent image on the latent image bearing member having been statically charged;

a developing means for developing said electrostatic latent image to form a toner image on said latent image bearing member;

a transfer means for transferring said toner image to a transfer medium from said latent image bearing member;

a cleaning means for cleaning the surface of said latent image bearing member to remove toner remaining thereon untransferred; and a fixing means for fixing the toner image transferred to said transfer medium by the action of heat and pressure; wherein;

said developing means retains a developer comprising a toner containing a binder resin and a colorant, said binder resin being comprised of an AB-type block copolymer having segment-A and segment-B; said segment-A having a copolymer structure comprised of a styrene monomer and at least one monomer selected from the group consisting of an acrylic monomer, a methacrylic monomer and a diene monomer, and said segment-B having a copolymer structure comprised of a styrene monomer and at least one monomer selected from the group consisting of an acrylic monomer, a methacrylic monomer and a diene monomer, provided that said segment-A and segment-B have copolymer structures different from each other.

DESCRIPTION OF THE PREFERRED EMBODIMENTS

Figure 1:
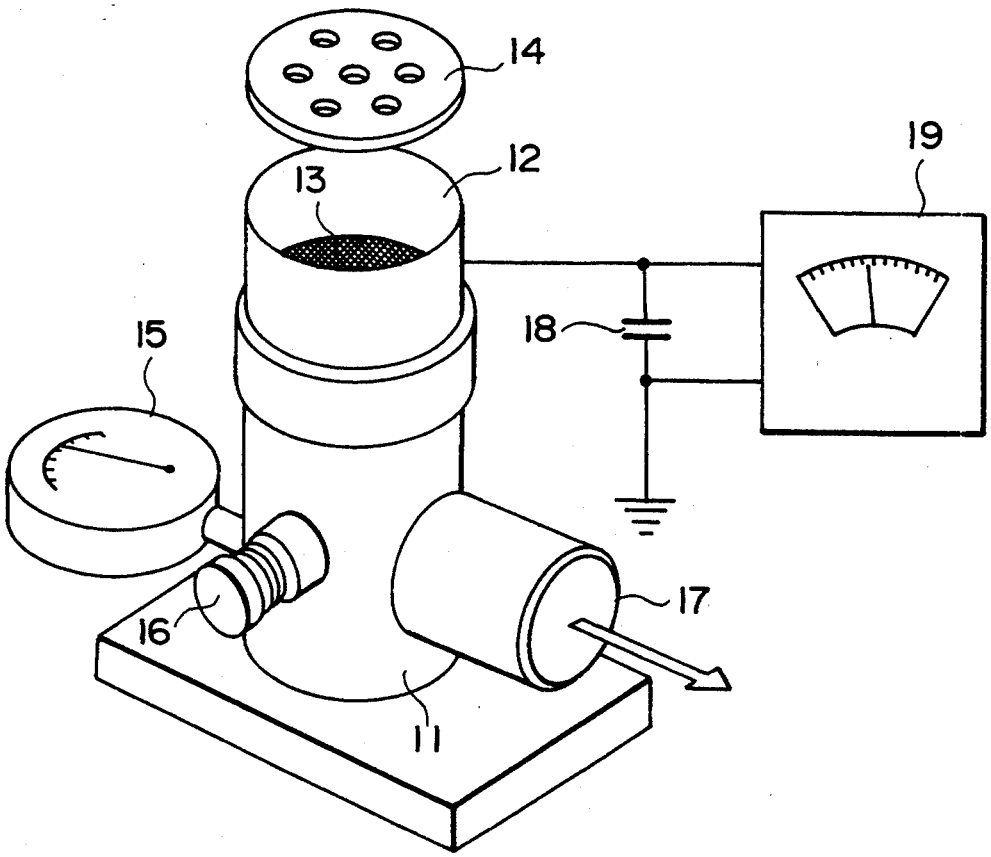
FIG. 1 illustrates an apparatus for measuring quantity of triboelectricity according to the present invention.

As a result of extensive studies, the present inventors have discovered that the objects of the present invention can be achieved by a toner containing a binder resin containing a polymer synthesized from vinyl monomers or a mixture with such a polymer, wherein said binder resin is comprised of an AB-type block copolymer having segment-A and segment-B; said segment-A having a copolymer structure comprised of a styrene monomer and at least one monomer selected from the group consisting of an acrylic monomer, a methacrylic monomer and a diene monomer, and said segment-B having a copolymer structure comprised of a styrene monomer and at least one monomer selected from the group consisting of an acrylic monomer, a methacrylic monomer and a diene monomer, provided that said segment-A and segment-B have copolymer structures different from each other.

The present inventors have understood the reason therefor as follows:

In general, block copolymers are known to have what is called a domain-matrix structure.

In regard to the block copolymers, for example, Japanese Patent Publication No. 57-6585 discloses a method in which an ABA-type block copolymer comprised of a component-A soft polymer having a glass transition point of 20° C. or below and a component-B tough polymer having a glass transition point of 50° C. or above is used as a resin for a pressure fixing toner.

Nowadays, a method most commonly available at present is the heating system. In particular, the pressure heating system making use of a heating roller is a method of carrying out fixing by causing an image-receiving sheet to pass over a heating roller whose surface is formed of a material having a releasability to toner while a toner image surface of the former is brought into contact with the surface of the latter under application of a pressure. Since in this method the surface of the heating roller comes into contact with the toner image of the image-receiving sheet under application of a pressure, a very good thermal efficiency can be achieved when the toner image is melt-adhered onto the image-receiving sheet, so that fixing can be carried out rapidly. Thus, this method is very effective in high-speed electrophotographic copying machines.

It, however, is possible that the heat generated at the time of fixing brings about a rise of temperature in the inside of the machine. This may cause an undesirable phenomenon that the blocking of toner occurs during its storage, and hence there is an increasing severe demand for the prevention of blocking. In such a heat fixing system, the toner obtained using the resin comprising the component-A soft polymer having a glass transition point of 20° C. or below tends to cause the blocking in apparatus, resulting in a poop fluidity of the powder to make it difficult to obtain good images.

On the other hand, in the AB-type block copolymer according to the present invention, the segment-A gives the blocking resistance and high-temperature anti-offset performance and the segment-B imparts the low-temperature fixing performance. More specifically, for the purpose of function separation, copolymer structures such as molecular weight, monomer composition and compositional proportion of monomers are made different between the segment-A and the segment-B. The segment-A and segment-B may preferably have a number average molecular weight (segment-A: MnA; segment-B: MnB) measured by gel permeation chromatography (GPC) of $500 \leqq MnB < MnA$. In an instance where the AB-type block copolymer having segment-A and segment-B has different glass transition points different from each other (segment-A: TgA; segment-B: TgB), it may preferably have glass transition points of $25° C. \leqq TgB < TgA \leqq 90° C.$, and also may preferably have a glass transition point in the temperature range that shows a largest endothermic change, of from 40° to 85° C., and more preferably from 45° to 65° C. In an instance where the AB-type block copolymer has one glass transition point, it may preferably have a glass transition point of $40° C. \leqq Tg \leqq 85° C.$, and more preferably $45° C. \leqq Tg \leqq 65° C.$ In the present invention, in the instance where the block copolymer has two or more glass transition points, the glass transition point in the temperature range that shows a largest endothermic change within the range of temperatures of from 25° C. to 90° C. is regarded as the glass transition point in the present invention. On account of such constitution, a toner with an excellent low-temperature fixing performance can be obtained because of the structure comprised of the segment-A serving as a matrix, as having a large molecular chain length, and the segment-B serving as a domain, where the segment-B commonly having a weak blocking resistance and a low-temperature fixing performance is individually present as the domain and hence the segment-A, a matrix with a continuous phase, achieves the blocking resistance.

As for the low-temperature fixing, it is imparted by the action of the segment-B when heating is carried out at the time of fixing.

Herein, the segment-A and segment-B are connected with each other, and hence, different from an instance where each polymer is separately present as in a polymer blend, the segment-A and segment-B mutually acts to achieve both the high-temperature anti-offset performance attributable to the segment-A and the low-temperature fixing performance attributable to the segment-B.

In order to more satisfactorily achieve the objects of the present invention, the present inventors made further extensive studies. As a result, they have discovered that better results can be obtained when vinyl monomers containing carboxyl groups are copolymerized.

More specifically, together with the effect attributable to the domain-matrix structure, the copolymerization of vinyl monomers containing carboxyl groups brings about a large polarity of the binder resin, and, as a result, makes it possible to improve compatibility with paper and to improve fixing performance. Hence, it becomes possible to enhance the Tg (glass transition point) of the binder resin, so that the blocking resistance can be more improved.

The binder resin according to the present invention may be further incorporated with a polymer synthesized from a vinyl monomer.

Herein, in the instance where the AB-type block copolymer has respectively different glass transition points (TgA, TgB), the blocking tends to occur if the TgB is lower than 25° C., and the fixing performance of the toner tends to be lowered if the TgA is higher than 90° C. In the instance where the AB-type block copolymer has the same glass transition point, the blocking tends to occur if the Tg is lower than 40° C., and on the other hand the fixing performance of the toner tends to be lowered if the Tg is higher than 85° C.

The toner according to the present invention can be used in either one-component developers or two-component developers. Particularly when used in two-component developers, the toner can be used in a vast range from monochrome electrophotography to full-color electrophotography.

In the instance where the toner according to the present invention is used in full-color electrophotography so that its characteristics can be well exhibited, the AB-type block copolymer and/or a mixture thereof with the polymer synthesized from vinyl monomers containing carboxyl groups or the polymer synthesized from vinyl monomers should preferably have a number average molecular weight (Mn) of from 1,500 to 30,000, and more preferably from 2,000 to 20,000, and should also preferably have a weight average molecular weight (Mw) of from 4,000 to 50,000, and more preferably from 6,000 to 35,000.

In the instance where it is used in one-component developers or monochrome electrophotography, the binder resin should preferably have a number average molecular weight (Mn) of from 2,500 to 40,000, and more preferably from 3,500 to 20,000, and a weight average molecular weight (Mw) of preferably from 20,000 to 500,000, and more preferably from 35,000 to 350,000.

In an instance where the AB-type block copolymer is an (AB)n-type block copolymer, the repeat number n may preferably be 1 to 20. This is because an AB-type block copolymer with a repeat number n more than 20 may be the same as a random or alternating copolymer, resulting in a decrease in properties inherent in the block copolymer. Thus, in the case of the toner for full colors, having a low molecular weight component, the repeat number n may preferably be in the range of from 1 to 10. In the case of toner for one-component developers or monochrome electrophotography, having a high molecular weight, the repeat number n may preferably be in the range of from 1 to 15. These ranges are preferable in order for the above properties inherent in block copolymers to be well exhibited.

The binder resin used in the present invention can be satisfactory if it contains the AB-type block copolymer in any amount. In order for the properties of the block copolymer to be more effectively be exhibited, the binder resin may preferably contain the block copolymer in an amount of not less than 30% by weight and more preferably not less than 50% by weight.

The polymer synthesized from vinyl monomers containing carboxyl groups or the polymer synthesized from vinyl monomers, other than the block copolymer in the binder resin, may preferably have a glass transition point of from 40° C. to 85° C., more preferably from 45° C. to 70° C., and still more preferably from 55°

C. to 65° C., in order for the properties of the block copolymer to be well exhibited.

The heat fixing method is herein meant to be a method of fixing a toner image by heating, as exemplified by a pressure heating method making use of a heating roller, and a method in which a recording medium is opposingly brought into pressure contact with a heating element and also into close contact with it via a film.

The copolymers segment-A and segment-B that constitute the AB-type block copolymer used in the present invention are obtained by copolymerization of styrene monomer with at least one monomer selected from the group consisting of an acrylic monomer, a methacrylic monomer and a diene monomer, and may preferably be copolymerized together with a vinyl monomer containing a carboxy group.

The styrene monomer may include, for example, styrene, and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene.

The acrylic monomer may include acrylic acid esters such as methyl acrylate, ethyl acrylate, n-butyl acrylate, iso-butyl acrylate, propyl acrylate, n-octyl acrylate, dodecyl acrylate, 2-ethylhexyl acrylate, stearyl acrylate, 2-chloroethyl acrylate and phenyl acrylate.

The methacrylic monomer may include methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate.

The diene monomer may include unsaturated diolefins such as butadiene and isoprene.

In the case when the acrylic monomer is selected as the monomer used in combination with the styrene monomer in the AB-type block copolymer according to the present invention, the compositional proportion of styrene monomer/acrylic monomer in the segment-A copolymer may preferably be from 98/2 to 50/50, and more preferably from 95/5 to 65/35. The compositional proportion of styrene monomer/acrylic monomer in the segment-B copolymer may preferably be from 95/5 to 40/60 and more preferably from 85/15 to 50/50.

Similarly, in the case when the methacrylic monomer is selected, the compositional proportion of styrene monomer/methacrylic monomer in the segment-A copolymer may preferably be from 95/5 to 30/70, and more preferably from 90/10 to 40/60, and the compositional proportion of styrene monomer/methacrylic monomer in the segment-B copolymer may preferably be from 92/8 to 25/75, and more preferably from 87/13 to 35/65.

Still similarly, in the case when the diene monomer is selected, the compositional proportion of styrene monomer/diene monomer in the segment-A copolymer may preferably be from 98/2 to 65/35, and more preferably from 95/5 to 75/25, and the compositional proportion of styrene monomer/diene monomer in the segment-B copolymer may preferably be from 96/4 to 60/40, and more preferably from 94/6 to 70/30. In particular, in the case when the diene monomer is selected, the acrylic monomer and/or methacrylic monomer may preferably be used in combination therewith. In this instance, the compositional proportion of styrene monomer/diene monomer/acrylic monomer/methacrylic monomer may preferably be 60 to 98/2 to 35/0 to 30/0 to 30 in each of the segment-A and segment-B.

The vinyl monomer having a carboxyl group that may be copolymerized to the segment-A and/or segment-B in the present invention may include acrylic acid, methacrylic acid, crotonic acid, itaconic acid, cinnamic acid, maleic anhydride, fumaric acid, maleic acid, and their monoesters such as methyl, ethyl, butyl and 2-ethylhexyl, at least one of which may be used.

The monomers as described above may preferably be copolymerized in an amount of from 0.1 to 30% by weight based on the AB-type block copolymer, and may more preferably copolymerized in an amount of from 0.5 to 20% by weight.

The vinyl monomer containing a carboxyl group may be copolymerized with any one of the segment-A and segment-B, or may be copolymerized with the both segment-A and segment-B. In the case when the vinyl monomer containing a carboxyl group is copolymerized with the both segment-A and segment-B, the weight proportion in copolymerization of the both may be the same or may be different.

Other monomers may also be copolymerized with the segment-A and/or segment-B so long as they do not adversely affect the present invention.

The vinyl monomer that may constitute the binder resin used in the form of a mixture of the AB-type block copolymer may include the following:

For example, styrene, and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene and unsaturated monoolefins such as ethylene, propylene, butylene and isobutylene; unsaturated diolefins such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic acid and esters thereof such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid, and acrylic acid esters such as methyl acrylate, ethyl acrylate, n-butyl acrylate, isobutyl, acrylate, propyl acrylate, n-octyl acrylate, dodecyl acrylate, 2-ethylhexyl acrylate, stearyl acrylate, 2-chloroethyl acrylate and phenyl acrylate; maleic acid, and maleic acid half esters; vinyl ethers such as methyl vinyl ether, ethyl vinyl ether and isobutylvinyl ether; vinyl ketones such as methyl vinyl ketone, hexyl vinyl ketone and methyl isopropenyl ketone N-vinyl compounds such as N-vinylpyrrole, N-vinylcarbazole, N-vinylindole and N-vinylpyrrolidone; vinyl naphthalenes; acrylic acid or methacrylic acid derivatives such as acrylonitrile, methacrylonitrile and acrylamide; and acroleic acid. A polymer of one or more kinds of any of these may be used.

The polymer synthesized from the vinyl monomers can be obtained by a conventionally commonly known method, including, for example, a method in which solution or suspension polymerization is carried out using a peroxide as an initiator.

The AB-type block copolymer can be synthesized by the method disclosed in Japanese Patent Applications Laid-Open No. 63-278910, No. 63-273601 and No. 64-111, which is a method in which radical polymerizable vinyl monomers are subjected to bulk polymerization or solution polymerization by light, using a polymerization initiator having a dithiocarbamate group. The polymer synthesized from the vinyl,monomers can be obtained by a conventionally commonly known method, including, for example, a method in which solution or suspension polymerization is carried out using a peroxide as an initiator.

The toner for electrophotography in the present invention can be applied to either one-component developers or two-component developers. In order for the toner according to the present invention is used in one-component developers, it may be incorporated with a magnetic powder. Such a magnetic powder may include materials capable of being magnetized when placed in a magnetic field, as exemplified by powders of ferromagnetic metals such as iron, cobalt and nickel, and alloy or compounds such as magnetite, hematite and ferrite. This magnetic powder may be contained in an amount of from 15 to 70% by weight based on the weight of the toner.

Regardless of the one-component developers or two-component developers, carbon black, titanium white or other all sorts of pigment and/or dye can be used in the toner as the colorant.

For example, in instances in which the toner according to the present invention is used as a magnetic color toner, the dye may include C.I. Direct Red 1, C.I. Direct C.I. Red 4, Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6. The pigment may include chrome yellow, cadmium yellow, mineral fast yellow, antimony yellow, Naphthol Yellow S, Hanza Yellow G, Permanent Yellow NCG, Tartrazine Yellow Lake, chrome orange, molybdenum orange, Permanent Orange GTR, Pyrazolone Orange, Benzidine Orange G, cadmium red, Permanent Red 4R, Watching Red calcium salt, eosine lake, Brilliant Carmine 3B, manganese violet, Fast Violet B, Methyl Violet Lake, prussian blue, cobalt blue, alkali blue lake, Victoria blue lake, Phthalocyanine Blue, Fast Sky Blue, Indanethlene Blue BC, chrome green, chromium oxide, Pigment Green B, Malachite Green and Final Yellow Green G.

In instances in which the toner according to the present invention is used as a full-color toner contained in two-component developers, the colorant may include the following:

A magenta Color pigment may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48i 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Vat Red 1, 2, 10, 13, 15, 23, 29, 35.

The pigment may be used alone. In view of image quality of full-color images, it is preferred to use the dye and the pigment in combination so that the sharpness of images can be improved.

A magenta dye may include oil-soluble dyes such as C.I. Solvent Red 1, 3, 8, 23, 24, 25, 27, 30, 49, 81, 82, 83, 84, 100, 109, 121, C.I. Disperse Red q; C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

A cyan color pigment may include C.I. Pigment Blue 2, 3, 15, 16, 17, C.I. Vat Blue, C.I. Acid Blue 45, or a copper phthalocyanine pigment comprised of a phthalocyanine skeleton substituted thereon with 1 to 5 phthalimidomethyl groups, having the structure represented by the following formula (1).

Formula (1)

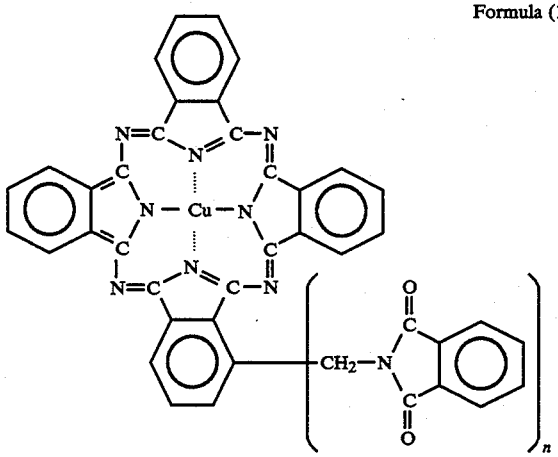

n = 1 to 5

A yellow color pigment may include C.I. Pigment Yellow 1, 2, 3, 4, 5, 6, 7, 10, 11, 12, 13, 14, 15, 16, 17, 23, 65, 73, 83, and C.I. Vat Yellow 1, 3, 20.

The colorant may be used in an amount of from 0.1 part by weight to 60 parts by weight, and preferably from 0.5 part by weight to 50 parts by weight, based on 100 parts by weight of the binder resin.

In the toner according to the present invention, there are no limitations on whether it is negatively chargeable or positively chargeable. In the case when a negatively chargeable toner is prepared, a negative charge control agent may preferably be added for the purpose of stabilizing negatively chargeable properties. The negative charge control agent may include, for example, organic metal complexes such as metal complexes of alkyl-substituted salicylic acid as exemplified by chromium complexes or zinc complexes of di-tert-butylsalicylic acid, or azo type metal complexes as exemplified by an azo type chromium complex represented by the following formula (2).

Formula (2)

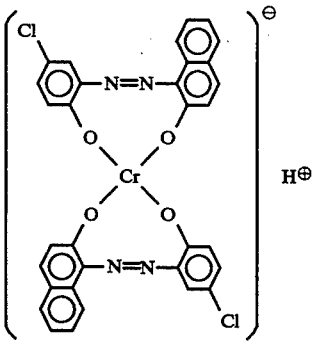

In the case when a positively chargeable toner is prepared, a Nigrosine triphenylmethane compound, a rhodamine dye or polyvinyl pyridine can be used as a charge control agent capable of exhibiting positive chargeability. In the case when a positively chargeable color toner is prepared, an amino-containing carboxylate such as dimethylaminomethyl methacrylate capable of exhibiting positive chargeability may be incorporated in the binder resin in an amount of from 0.1 to 40 mol %, and preferably from 1 to 30 mol %. Alternatively, a colorless or pale color positive charge control agent having no influence on the color tone of toners can also be used. Such a positive charge control agent may include, for example, quaternary ammonium salts represented by the following structural formulas (3) and (4).

Formula (3)

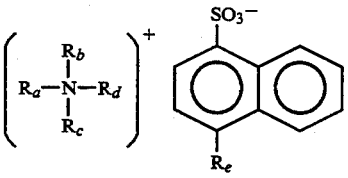

wherein Ra, Rb, Rc and Rd each represent an alkyl group having 1 to 10 carbon atoms or a phenyl group represented by

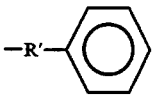

(R': an alkyl group having 1 to 5 carbon atoms); and Re represents —H, —OH, —COOH or an alkyl group having 1 to 5 carbon atoms.

Formula (4)

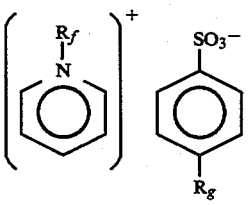

wherein Rf represents an alkyl group having 1 to 5 carbon atoms, and Rg represents —H, —OH, —COOH or an alkyl group having 1 to 5 carbon atoms.

Of the quaternary ammonium salts represented by the above structural formulas (3) and (4), positive charge control agents represented by the following structural formulas (3)-A, (3)-B and (4)-A may particularly preferably be used in view of good chargeability with less environment dependence.

Formula (3)-A

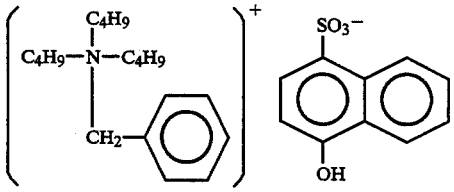

Formula (3)-B

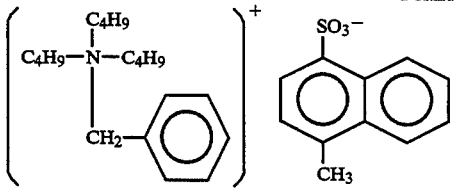

Formula (4)-A

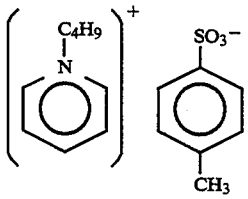

In the case when the amino-containing carboxylate such as dimethylaminomethyl methacrylate capable of exhibiting positive chargeability is used as the resin component of the binder resin in the positively chargeable toner, the positive charge control agent and the negative charge control agent can be used in combination if necessary.

In the case of the negatively chargeable toner, the negative charge control agent should preferably be used in an amount of from 0.1 part by weight to 15 parts by weight, and more preferably from 0.5 part by weight to 10 parts by weight, based on 100 parts by weight of the binder resin.

In the case when the amino-containing carboxylate such as dimethylaminomethyl methacrylate capable of exhibiting positive chargeability is not used as the resin component of the binder resin in the positively chargeable toner, the positive charge control agent should preferably be used in an amount of from 0.1 part by weight to 15 parts by weight, and more preferably from 0.5 part by weight to 10 parts by weight, based on 100 parts by weight of the binder resin. In the case when the amino-containing carboxylates are used, the positive charge control agent and/or negative charge control agent should preferably be used in an amount of from 0 to 10 parts by weight, and more preferably from 0 to 8 parts by weight, based on 100 parts by weight of the binder resin, if necessary for the purpose of giving a good chargeability with less environment dependence.

The developer of the present invention may also contain a fluidity improver for the purpose of improving the fluidity of the toner.

As the fluidity improver used in the present invention, any agent can be used so long as its addition to colorant-containing resin particles can bring about an increase in fluidity when compared before and after its use.

For example, the fluidity improver may include fluorine-containing resin powders such as fine vinylidene fluoride powder and fine polytetrafluoroethylene powder; fatty acid metal salts such as zinc stearate, calcium stearate and lead stearate; metal oxides such as zinc oxide; and fine powders such as wet process silica, dry process silica, and treated silica obtained by subjecting any of them to particle surface treatment using a surface treatment such as a silane coupling agent, a titanium coupling agent and silicone oil.

Of the above fluidity improvers, particularly preferred ones may include the following:

(A) Fine silica powder treated with a coupling agent containing an amino group or a silicone oil containing an amino group, and further subjected to hydrophobic treatment using an organic silicon compound.

(B) Fine silica powder having been treated with a silane coupling agent, and further treated with silicone oil.

The former fine silica powder (A) will be first described.

The fine silica powder produced by vapor phase oxidation of a silicon halide refers to those called dry process silica or fumed silica, which can be produced by conventionally known techniques. For example, it is a process that utilizes heat decomposition oxidation reaction in the oxyhydrogen flame of silicon tetrachloride gas. The reaction basically proceeds as follows.

$$SiCl_4+2H_2+O_2 \rightarrow SiO_2+4HCl$$

In this preparation step, it is also possible to use a metal halide such as aluminum chloride or titanium chloride together with the silicon halide to give a composite fine powder of silica and other metal oxide. The fine silica powder of the present invention includes these, too.

The powder may preferably have a particle diameter ranging from 0.001 to 2$\mu$ as average primary particle diameter. It is more preferable to use fine silica powder with a particle diameter ranging from 0.002 to 0.2$\mu$.

Commercially available fine silica powders usable in the present invention, produced by the vapor phase oxidation of the silicon halide, include, for example, those which are on the market under the following trade names.

Aerosil 130, 200, 300, 380, TT600, MOX80, MOX170, COK84 (Aerosil Japan, Ltd.);

Ca—O—SiL M-5, MS-7, MS-75, HS-5, EH-5 (CABOT CO.);

Wacker HDK N 20, V15, N20E, T30, T40 (WACKER-CHEMIE GMBH);

D-C Fine Silica (Dow-Corning Corp.); and Fransol (Franzil Co.).

In the present invention, it is more preferred to use a treated fine silica powder, obtained by applying a hydrophobic treatment to the fine silica powder produced by gaseous phase oxidation of a silicon halide. In the treated fine silica powder, particularly preferred is a fine silica powder so treated as to have a hydrophobicity in the range of from 30 to 80 as measured by methanol titration.

As a method for the hydrophobic treatment, the fine silica powder can be made hydrophobic by its chemical treatment with a treatment such as an organic silicon compound capable of reacting with, or being physically adsorbed on, the silica fine powder.

A preferred method includes a method in which the fine silica powder produced by vapor phase oxidation of a silicon halide is treated with an organic silicon compound.

The organic silicon compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, $\alpha$-chloroethyltrichlorosilane, $\beta$-chloroethyltrichlorosilane, chloromethyldimethylchlorosilane, triorganosilyl mercaptan trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyl-disiloxane, and a dimethylpolysiloxane having 2 to 12 siloxane units per molecule and containing a hydroxyl group bonded to each Si in the units positioned at the terminals. These may be used alone or in the form of a mixture of two or more kinds.

The treated fine silica powder may have a particle diameter Tanging from 0.003 to 0.1$\mu$, which can be preferably Used. Commercially available products may include TALANOX-500 (Talco Co.) and AEROSIL R-972 (Nippon Aerosil Co., Ltd.).

With regard to the positively chargeable toner, it is preferred to use positively chargeable fine silica powder so that a good chargeability with less environment dependence can be achieved.

In order to obtain such positively chargeable fine silica powder, it may be treated with a coupling agent or silicone oil containing an amino group.

The coupling agent containing an amino group may include aminosilane coupling agents as exemplified by the following:

$H_2NCH_2CH_2CH_2Si(OCH_3)_3$
$H_2NCH_2CH_2CH_2Si(OC_2H_5)_3$ $H_2NCH_2CH_2CH_2Si(CH_3)(OCH_3)_3$ $H_2NCH_2CH_2NHCH_2CH_2CH_2Si(CH_3)(OCH_3)_2$ $H_2NCONHCH_2CH_2CH_2Si(OC_2H_5)_3$
$H_2NCH_2CH_2NHCH_2CH_2CH_2Si(OCH_3)_3$
$H_2NCH_2CH_2NHCH_2CH_2NHCH_2CH_2CH_2Si(OCH_3)_3$
$H_5C_2OCOCH_2CH_2NHCH_2CH_2CH_2Si(OCH_3)_3$
$H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NH$
$CH_2CH_2CH_2Si(OCH_3)_3$ $H_3COCOCH_2CH_2NHCH_2CH_2NHCH_2CH_2CH_2Si(OCH_3)_3$ $(H_5C_2)_2N-CH_2CH_2CH_2Si(OCH_3)_3$

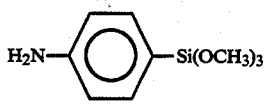

-continued

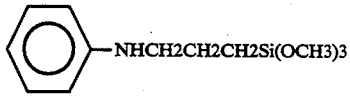

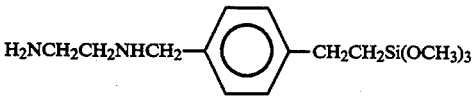

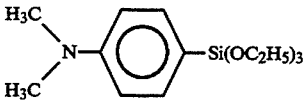

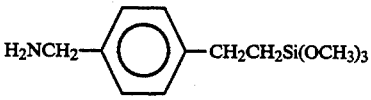

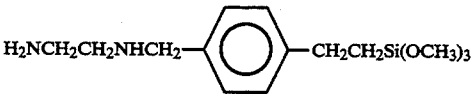

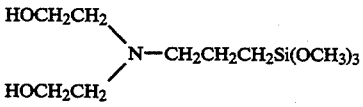

$(H_2CO)_3SiCH_2CH_2CH_2—NHCH_2$

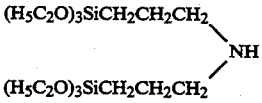

$H_2CNHCH_2CH_2CH_2Si(OC_2H_5)_3$
$H_2N(CH_2CH_2NH)_2CH_2CH_2CH_2Si(OCH_3)_3$
$H_3C—NHCONHC_3H_6Si(OCH_3)_3$

As for the silicone oil, an amino-modified silicone oil is used which has a partial structure having an amino group on the side chain as represented by the following Structural formula (5).

Formula (5)

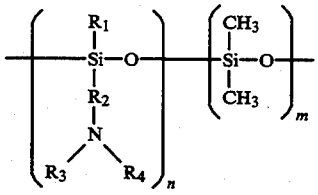

wherein $R_1$ represents a hydrogen atom, an alkyl group, an aryl group or an alkoxyl group; $R_2$ represents an alkylene group or a phenylene group; and $R_3$ and $R_4$ each represent a hydrogen atom, an alkyl group or an aryl group. The above alkyl group, aryl group, alkylene group and phenylene group may each contain amine, and may also have a substituent such as a halogen so long as the chargeability is not damaged. The letter symbols m and n each represent a positive integer.

The silicone oil having such an amino group can be exemplified by the following:

| Trade name | Viscosity at 25° C. (cps) | Amine equivalent |
|---|---|---|
| SF8417 (Toray Silicone Co., Ltd.) | 1,200 | 3,500 |
| KF393 (Shin-Etsu Chemical Co., Ltd.) | 60 | 360 |
| KF857 (Shin-Etsu Chemical Co., Ltd.) | 70 | 830 |
| KF860 (Shin-Etsu Chemical Co., Ltd.) | 250 | 7,600 |
| KF861 (Shin-Etsu Chemical Co., Ltd.) | 3,500 | 2,000 |
| KF862 (Shin-Etsu Chemical Co., Ltd.) | 750 | 1,900 |
| KF864 (Shin-Etsu Chemical Co., Ltd.) | 1,700 | 3,800 |
| KF865 (Shin-Etsu Chemical Co., Ltd.) | 90 | 4,400 |
| KF369 (Shin-Etsu Chemical Co., Ltd.) | 20 | 320 |
| KF383 (Shin-Etsu Chemical Co., Ltd.) | 20 | 320 |
| X-22-3680 (Shin-Etsu Chemical Co., Ltd.) | 90 | 8,800 |
| X-22-380D (Shin-Etsu Chemical Co., Ltd.) | 2,300 | 3,800 |
| X-22-3801C (Shin-Etsu Chemical Co., Ltd.) | 3,500 | 3,800 |
| X-22-3810B (Shin-Etsu Chemical Co., Ltd.) | 1,300 | 1,700 |

In the for going, the amine equivalent refers to the equivalent per amine (g/equiv), which is a value obtained by dividing the molecular weight by the amine number per molecule.

The fine silica powder treated with such coupling agent or silicone oil containing an amino group may preferably be further subjected to hydrophobic treatment using the organic silicon compound previously described, and then put into use.

The latter fine silica powder (B) will be next described.

It has been prevalent in the present research field to add and mix fine silica powder in toner powder so that developers can be made to have a high fluidity and a uniform chargeability.

The fine silica powder is hydrophilic as such and hence developers to which this powder has been added may be agglomerated because of the moisture in the air to cause a lowering of fluidity, and, in an extreme instance, may undergo a lowering of charge performance of the developer as a result of the absorption of moisture by silica. For this reason, it has been proposed to use fine silica powder having been subjected to hydrophobic treatment, as disclosed in Japanese Patent Applications Laid-open No. 46-5782, No. 48-47345 and No. 48-47346. More specifically, it is a method in which fine silica powder and a silane coupling agent are reacted to substitute silanol groups present on the particle surfaces of fine silica powder with other organic groups to make the powder hydrophobic, where, e,g., dimethyldichlorosilane or trimethylalkoxysilane is used as the silane coupling agent.

Such fine silica powder has been made hydrophobic to a certain degree, but can not be said to have been made hydrophobic to a sufficient degree, tending to cause a lowering of charge performance of developers when left to stand in an environment of a high humidity.

The present inventors made studies on various kinds of fine silica powder. As a result, they have found that a fine silica powder having been treated with a silane coupling agent and then further treated with a silicone oil can avoid the above disadvantages.

In the conventional treatment with a silane coupling agent, it is difficult to break up all the silanol groups of the fine silica powder. The absorption of moisture by the remaining silanol groups in an environment of high humidity is only the steric hindrance ascribable to the molecules of silane coupling agent after completion of the reaction, and hence it is impossible to completely prevent the remaining silanol groups from absorbing moisture.

In the treatment with silicone oil, on the other hand, the silicone oil is coated on the particle surfaces of the fine silica powder, so that it can completely cover the silanol groups, resulting in a great increase in moisture resistance. However, only the treatment with silicone oil may result in so large a quantity of silicone oil for covering the particle surfaces of fine silica powder that agglomerates of the fine silica powder tend to be produced during its treatment, bringing about the problems such that the developer has a poor fluidity when the toner is applied to the developer. Taking account of the above problems, the present inventors made extensive studies to have discovered that, in order to remove agglomerates of fine silica powder while keeping a good moisture resistance, the fine silica powder having been treated with a silane coupling agent may be treated with a small quantity of silicone oil, whereby the above problems can be overcome.

The fine silica powder used in the present invention may include what is called dry process silica or called fumed silica, produced by vapor phase oxidation of a silicon halide, and what is called wet process silica, produced from water glass or the like, both of which can be used. The dry process silica is preferred since it has less silanol groups present on the surfaces and interiors of fine silica powder particles and also is free from preparation residues such as $Na_2O$ and $SO_3^{2-}$.

In the dry process silica, it is also possible to use a metal halide such as aluminum chloride or titanium chloride together with the silicon halide to give a composite fine powder of silica and other metal oxide. The fine silica powder of the present invention includes these, too.

The powder may preferably have a particle diameter ranging from 0.001 to 2μ as average primary particle diameter. It is more preferable to use fine silica powder with a particle diameter ranging from 0.002 to 0.2μ.

The silane coupling agent used in the present invention is a compound represented by the following structural formula (6).

$$R_mSiY_n \qquad \text{Formula (6)}$$

wherein R represents an alkoxyl group or a chlorine atom; m is an integer of 1 to 3; Y represents a hydrocarbon group including an alkyl group, a vinyl group a glycidoxy group and a methacrylic group; and n represents an integer of 3 to 1.

The compound represented by the above structural formula (6) may include, for example, dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane and dimethylvinylchlorosilane.

The treatment of fine silica powder with the silane coupling agent can be carried out by a commonly known method such as the dry processing in which a fine silica powder brought into a cloud by stirring is reacted with a vaporized silane coupling agent, or the wet processing in which fine silica powder is dispersed in a solvent and the silane coupling agent is dropwise added to the solution to allow them to react.

The silicone oil used in the present invention is a compound represented by the following structural formula (7).

$$R''R_2SiO\left(\underset{\underset{R'}{|}}{\overset{\overset{R}{|}}{SiO}}\right)_n\left(\underset{\underset{R}{|}}{\overset{\overset{R}{|}}{SiO}}\right)_m-SiR_2R'' \qquad \text{Formula (7)}$$

wherein R represents an alkyl group having 1 to 3 carbon atoms; R′ represents a silicone oil modifying group such as an alkyl group, a halogen-modified alkyl group, a phenyl group or a modified phenyl group; and R″ represents an alkyl group having 1 to 3 carbon atoms or an alkoxyl group.

The silicone oil represented by the above structural formula (7) may include, for example, dimethylsilicone oil, an alkyl-modified silicone oil, α-methylstyrene-modified silicone oil, chlorophenylsilicone oil and a fluorine-modified silicone oil. These may be used alone or in the form of a mixture of two or more kinds.

As a preferred method for the silicone oil treatment, the fine silica powder produced by vapor phase oxidation of a silicon halide is treated with the silicone oil after it has been treated with the silane coupling agent previously described or at the same time when it is treated with the silane coupling agent; For example, the fine silica powder and the silicone oil may be directly mixed using a mixer such as a Henschel mixer, or may be treated by spraying the silicone oil to the base silica. Alternatively, after the silicone oil has been dissolved or dispersed in a suitable solvent, the fine silica powder may be mixed therein, followed by removal of the solvent to obtain the desired product.

The treated fine silica powder (A) or (B) described above may preferably be added in the developer in an amount of from 0.01 to 20% by weight based on the weight of the toner, within the range of which it has an effect, and more preferably in an amount of from 0.1 to 3% by weight within the range of which it gives an excellent chargeability. This treated fine silica powder should be added in such a form that from 0.01 to 3% by weight of the powder, based on the weight of the toner, is adhered to the toner particle surfaces.

In the toner according to the present invention, the toner may preferably have a volume average particle diameter of from 4 to 20 μm, and more preferably from 6 to 10 μm.

In particular, it is preferred that the toner has a weight average particle diameter of from 6 to 10 μm, toner particles with particle diameters not larger than 5 μm are contained in an amount of from 15 to 40% by number toner particles with particle diameters of from 12.7 to 16.0 μm are contained in an amount of from 0.1 to 5.0% by weight, tonex particles with particle diameters not smaller than 16 μm are contained in an amount of not more than 10% by weight, and toner particles with a particle diameter of from 6.35 to 10.1 μm have a particle size distribution satisfying the following expression:

$$9 \leqq \frac{V \times \bar{d}v}{N} \leqq 14$$

wherein V represents % by weight of the toner particles with particle diameters of from 6.35 to 10.1 μm; N represents % by number of the toner particles with particle diameters of from 6.35 to 10.1 μm; and dv represents a weight aver age particle diameter of the whole toner particles.

In such an instance , images can be reproduced faithfully to the latent image formed on the photosensitive member, and also a superior performance of reproducing fine dot latent images such as halftone images or digital images can be achieved. In particular, it is possible to give images with superior gradation and resolution at highlight portions. Moreover, the toner satisfying the above particle size distribution can maintain a high image quality even when copying or printing is continued, and also, even in the case of an image with a high density, makes it possible to carry out good development in a smaller toner consumption than non-magnetic toners with a relatively larger particle diameter which do hot satisfy the above particle size distribution. Thus, this toner has an economical advantage and also being advantageous in providing small-sized copiers or printers.

The reason why such effect can be obtained in the toner of the present invention is not necessarily clear. It can be presumed as follows:

It has been hitherto considered that, in toners, toner particles with particle diameters not larger than 5 μm must be positively decreased as a component having the following problems (1) to (4).

(1) It is difficult to control charges.

(2) The fluidity required for toners tends to be reduced.

(3) The toner may scatter or fly about to contaminate the machine.

(4) Fogging of images may occur.

Studies made by the present inventors, however, have revealed that the toner particles with particle diameters of about 5 μm are essential as a component for forming a high-quality image.

For example, using a two-component developer having a non-magnetic toner with a particle size distribution ranging from 0.5 μm to 30 μm and a carrier, latent images with varied latent image potentials on a photosensitive member were developed while changing the surface potential on the photosensitive member. The latent images were so made as to vary from a latent image with so large a development potential contrast that a large number of toner particles were used for the development, to a half-tone latent image, and also to a latent image with minute dots which were so small that only a small quantity of toner particles were used for the development. After the development, the toner particles on the photosensitive member, used for each development, were collected and their particle size distribution was measured. As a result, it was revealed that toner particles with particle diameters not larger than about 8 μm were present in a large number, in particular, toner particles with particle diameters of about 5 μm were present in a large number on the latent image comprised of minute dots. Thus, images with really superior reproducibility that are faithful to latent images without misregistration from the latent images can be obtained when the toner particles with particle diameters of about 5 μm are smoothly supplied for the development of latent images.

Toner particles with particle diameters of from 12.7 to 16.0 μm correlate with the necessity for the presence of the toner particles with particle diameters of about 5 μm. It is true that nonmagnetic toner particles with particle diameters not larger than 5 μm are capable of faithfully reproducing a latent image comprised of minute dots, but they have considerably high agglomerating properties in themselves and hence tend to reduce the fluidity required for toners.

The present inventors, aiming at an improvement of the fluidity, have attempted to add the aforesaid hydrophobic fine silica powder so that the fluidity can be improved. It, however, has been confirmed that the employment of only such a means can give only a very narrow scope of conditions for satisfying all the items of image density, toner scatter, fogging, etc. Then the present inventors further studied the particle size distribution of toner particles to have discovered that the fluidity can be more improved and a high image quality can be achieved, when toner particles with particle diameters not larger than 5 μm are incorporated in an amount of from 15 to 40% by number and also toner particles with particle diameters of from 12.7 μm to 16.0 μm are incorporated in and amount of from 0.1 to 5.0% by weight. This is presumably because the toner particles with particle diameters ranging from 12.7 μm to 16.0 μm have an appropriately controlled fluidity to the toner particles with particle diameters not larger than 5 μm, so that sharp images with a high density and superior resolution and gradation can be provided even when copying or printing is continued.

It is more preferable for the toner used in the present invention to satisfy the following relationship between the % by weight (V), % by number (N) and weight average particle diameter (dv), with regard to toner particles with particle diameters of 6.35 μm to 10.1 μm.

$$9 \leqq \frac{V \times \overline{dv}}{N} \leqq 14 \quad (6 \leqq dv \leqq 10)$$

During studies on the state of particle size distribution and the development performance, the present inventors have also discovered the presence of the particle size distribution most suited for achieving the objects, as shown by the above expression.

When the particle size distribution is controlled by the commonly available air classification, it can be understood that an instance in which the value of the above expression is large shows an increase in the toner particles with particle diameters of about 5 μm that are attributable to the faithful reproduction of minute-dot images, and an instance in which the value is small shows on the other hand a decrease in the toner particles with particle diameters of about 5 μm.

A much better fluidity of the toner and a more faithful latent image reproducibility can be achieved when the weight average particle diameter (dv) is in the range of from 6 μm to 10 μm and also the above relationship is further satisfied.

Toner particles with particle diameters larger than 16 μm should be controlled to be in an amount of not more than 1.0 % by weight, which is preferred to be as less as possible.

The particle component of the toner used in the present invention will be further detailed below. The toner particles with particle diameters not larger than 5 μm should be contained in an amount of from 15 to 40% by number, and more preferably from 20 to 35% by number, of the total particle number. If the toner particles with particle diameters not larger than 5 μm are less than 15% by number, toner particles effective for high image quality may be in short supply, in particular, effective toner particle components may decrease as the toner is used upon continuance of copying or printing, so that there is a possibility of losing the balance of particle size distribution of toner particles, defined in the present invention, to cause a gradual lowering of image quality. If they are more than 40 % by number, the toner particles tend to agglomerate one another and tend to form a mass of toner particles with larger particle diameters than the original ones, resulting in a coarse-image quality, a lowering of resolution, or an increase in the density difference between edges and inner areas of latent images, which tends to give images with little blank areas.

The toner particles ranging from 12.7 μm to 16.0 μm should be in an amount of from 0.1 to 5.0% by weight, and preferably from 0.2 to 3.0% by weight. If they are in an amount more than 5.0% by weight, image quality may become poor and also excessive development, i.e., over-feeding of toner, may occur to causing an increase in toner consumption. On the other hand, if they are in an amount less than 0.1% by weight, there is a possibility of a decrease in image density because of a lowering of fluidity.

The toner particles with particle diameters not smaller than 16 μm should be contained in an amount of not more than 1.0% by weight, and more preferably not more than 0.6% by weight. If they are in an amount more than 1.0% by weight, not only fine-line reproduction may be hindered, but also, in the step of transfer, the state of a delicate close contact between a photosensitive member and a transfer sheet through a toner layer may become irregular to tend to cause variations in transfer conditions, because a few coarse toner particles with particle diameters not smaller than 16 μm may be protrudently present at the surface of a thin layer comprising the toner particles used for development, formed on the photosensitive member.

The toner should have a weight average particle diameter,of preferably from 6 μm to 10 μm, and more preferably from 7 μm to 9 μm. This value must be taken into account together with the respective component factors previously described. A toner with a weight average particle diameter smaller than 6 μm may give an insufficient toner transfer quantity on the transfer sheet, tending to cause the problem of a low image density. This is presumed to be caused by the same reason for the problem that the density decreases at inner areas of latent images with respect to edges thereof. The toner with a weight average particle diameter larger than 9 μm can give good resolution, not tending to cause a lowering of image quality even in the course of its continuous use from the beginning of copying.

Use of the toner having the particle size distribution as described above makes it possible to obtain a good fluidity and also to obtain copied images with a high resolution, high detail and high image quality.

A stable chargeability can be ensured even in an environment of high temperature and high humidity and also no toner scatter nor fogging occurs when the toner having the a foresaid particle size distribution is used in combination with the fine silica powder treated with the aforesaid fluidity improver, in particular, the silane coupling agent, and thereafter further treated with the silicone oil to make particle surfaces hydrophobic. Such effect is greatly attributable to the treatment of the fine silica powder to make its particle surfaces hydrophobic. Moreover, the charges do not become excessive even in an environment of low humidity. Hence a good transfer performance can be achieved and any faulty cleaning and leakage from a cleaner can be prevented.

The toner having the above specific particle size distribution can be produced in the following way: The thermoplastic resin is thoroughly mixed with the pigment or dye serving as the colorant, which may be optionally used, the charge control agent and other additives by means of a mixing machine such as ball mill. Thereafter the mixture is melted, kneaded and compounded to make resins melt one another, using a heat kneader such as a heating roll a kneader or an extruder. In the product thus compounded, the pigment or dye is dispersed or dissolved and then the dispersion is cooled to solidify, followed by pulverization and strict classification. Thus the toner with the relatively small particle diameters and specific particle size distribution can be obtained.

In instances in which the toner according to the present invention is used in two-component toner, a carrier used in development also plays an important roll in order for the toner to be well effective.

The carried that can be used in the present invention may include, for example, surface-oxidized or -unoxidized particles of metals such as iron, nickel, copper, zinc, cobalt, manganese, chromium and rare earth elements, or alloys or oxides of any of these, and ferrites. There are no particular limitations on the method of preparing them.

The system in which particle surfaces of the carrier described above are coated with a resin is particularly preferable in the J/B development process. As the method by which the carrier particles are coated with a resin, it is possible to use any conventionally known methods such as a method in which a coating material such as resin is dissolved or suspended in a solvent and then the solution or suspension is adhered to the carrier particles by coating, and a method in which they are merely mixed in the form of powder.

The material to be adhered to the carrier particle surfaces may be selected depending on the material for toners, and can be exemplified by polytetrafluoroethylene, monochlorotrifluoroethylene polymer, polyvinylidene fluoride, silicone resin, polyester resin, metal complexes of di-tert-butylsalicylic acid, styrene resins, acrylic resins, polyamide, polyvinyl butyral, Nigrosine, aminoacrylate resin, basic dyes or lakes thereof, fine silica powder, and fine alumina powder, any of which can be used alone or in plurality. Examples are by no means limited to these.

The amount in which the above compound is used for the treatment may be appropriately so determined that the carrier can satisfy the above conditions. In general, such a compound may preferably be used in an amount of from 0.01 to 30% by weight and more preferably from 0.1 to 20% by weight in total weight based on the weight of the carrier used in the present invention.

Any of these carriers may preferably have an average particle diameter of from 10 to 100μ, and more preferably from 20 to 70μ.

As a particularly preferred embodiment, the carrier may include Cu—Zn—Fe three-component ferrites whose particle surfaces are coated with a combination of resins such as a fluorine resin and a styrene resin, as exemplified by a mixture of polyvinylidene fluoride with styrene-methyl methacrylate resin, polytetrafluoroethylene with styrene-methyl methacrylate resin, or a fluorine copolymer with a styrene copolymer, mixed in a proportion of from 90:10 to 20:80, and preferably from 70:30 to 30:70, and which are coated ferrite carriers so coated in a coating weight of from 0.01 to 5% by weight and preferably from 0.1 to 1% by weight on the basis of total weight containing 70% by weight of carrier particles of 250 mesh-pass and 400 mesh-on and having the average particle diameter as described above. The fluorine copolymer can be exemplified by a vinylidene fluoride/tetrafluoroethylene copolymer (10:90 to 90:10). The styrene copolymer can be exemplified by a styrene/2-ethylhexyl acrylate copolymer (20:80 to 80:20) and a styrene/2-ethylhexyl acrylate/methyl methacrylate copolymer (20 to 60:5 to 30:10 to 50).

In the case when the two-component developer is prepared by mixture of the toner according to the present invention, the toner may be mixed in an amount of from 2% by weight to 15% by weight, preferably from 4% by weight to 13% by weight, in terms of toner concentration in the developer, within the range of which good results can be usually obtained. A toner concentration less than 2% by weight is not preferable in practical use because of a low image density, and on the other hand a toner concentration more than 15% by Weight may result in an increase in fogging or in-machine toner scatter to shorten the service life of the developer.

Methods of measurement in the present invention will be described below.

Measurement of Glass Transition Point Tg

In the present invention, the glass transition point is measured using a differential scanning calorimeter (DSC measuring device), DSC-7 (manufactured by Perkin-Elmer Inc.).

A sample to be measured is precisely weighed in a quantity of 5 to 20 mg, and preferably 10 mg.

This is put in an aluminum pan. Using an empty aluminum pan as a reference, the measurement is carried out in an environment of normal temperature and normal humidity at a measuring temperature range between 30° C. to 200° C., raised at a rate of 10° C./min.

During thins temperature rise, an endothermic peak of the main peak in the range of temperatures 40° C. to 100° C. is obtained. The point at which the line at a middle point of the base lines before and after appearance of the endothermic peak and the differential thermal curve intersect is regarded as the glass transition point Tg in the present invention.

Measurement of Molecular Weight

In the present invention, the molecular weight on the chromatogram obtained by GPC (gel permeation chromatography) are measured under the following conditions.

Columns are stabilized in a heat chamber of 40° C. To the columns kept at this temperature, THF (tetrahydrofuran) as a solvent is flowed at a flow rate of 1 ml per minute, and 50 μl to 200μl of a THF sample solution of a resin prepared to have a sample concentration of from 0.05 % to 0.6% by weight is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use, for example, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toyo Soda Manufacturing Co., Ltd., and to use at least about 10 standard polystyrene samples. An RI (refractive index) detector is used as a detector.

Columns should be used in combination of a plurality of commercially available polystyrene gel columns so that the regions of molecular weights of from $10^3$ to $2\times10^6$ can be accurately measured. For example, they may preferably comprise a combination of μ-Styragel 500, $10^3$, $10^4$ and $10^5$, available from Waters Co.; a combination of Shodex KF-80M, KF-801, 803, 804 and 805, or a combination of KA-802, 803, 804 and 805, available from Showa Denko K.K.; or a combination of TSKgel G1000H, G2000H, G2500H, G3000H, G4000H, G5000H, G6000H, G7000H and GMH, available from Toyo Soda Manufacturing Co., Ltd.

Measurement of Particle Size Distribution

A Coulter counter Type TA-II (manufactured by Coulter Electronics, Inc.) is used as a measuring device. An interface (manufactured by Nikkaki k.k.) that outputs number average distribution and weight average distribution and a personal computer CX-1 (manufactured by Canon Inc.) are connected. As an electrolytic solution an aqueous 1% NaCl solution is prepared using first-grade sodium chloride.

Measurement is carried out by adding as a dispersant 0.1 ml to 5 ml of a surface active agent, preferably an alkylbenzene sulfonate, to 100 ml to 150 ml of the above aqueous electrolytic solution, and further adding 0.5 mg to 50 mg of a sample to be measured.

The electrolytic solution in which the sample has been suspended subjected to dispersion for about 1 minute to about 3 minutes in an ultrasonic dispersion machine. The particle size distribution of particles of 2 μm to 40 μm are measured by means of the above Coulter Counter Type TA-II, using an aperture of 100 μm as its aperture. Then the weight average distribution and number average distribution are determined.

From the weight average distribution and number average distribution thus determined, the respective values corresponding to 5.04 μm or smaller in the weight average particle diameter and the number average particle diameter, and to 16.0 μm or larger in the weight average distribution are obtained.

Measurement of Triboelectric Charges

FIG. 1 illustrates an apparatus for measuring the quantity of triboelectricity. First, a mixture of i) particles the quantity of triboelectricity of which is to be measured and ii) magnetic particles used as the developer is prepared. They are mixed in a proportion of 5 parts by weight of the former particles to 95 parts by weight of the magnetic particles in the case of the toner and colorant-containing fine particles, and in a proportion of 2 parts by weight of the former particles to 98 parts by weight of the magnetic particles in the case of the fluidity improver.

The particles the quantity of triboelectricity of which is to be measured and the magnetic particles are placed in a measurement environment, and left to stand for 12 hours or more. Thereafter, these are put in a bottle made of polyethylene, and thoroughly mixed with stirring.

Next, the mixture of the particles the quantity of triboelectricity of which is to be measured and the magnetic particles is put in a measuring container 12 made of a metal at the bottom of which a conductive screen 13 of 500 meshes (the size is appropriately changeable so as for the magnetic particles not to pass) is provided, and the container is covered with a plate 14 made of a metal. The total weight of the measuring container 12 in this state is weighed and is expressed as $W_1$ (g). Next, in a suction device 11 (made of an insulating material at least at the apart coming into contact with the measuring container 12), air is withdrawn from a suction opening 17 and an air-flow control valve 16 is operated to control the pressure indicated by a vacuum indicator 15 to be 250 mmHg. In this state, suction is sufficiently carried out (preferably for about 2 minutes) to remove the toner by suction. The potential indicated by a potentiometer 19 at this time is expressed as V (volt). The numeral 18 denotes a capacitor, whose capacitance is expressed as C (μF). The total weight of the measuring container after completion of the suction is also weighed and is expressed as $W_2$ (g). The quantity of triboelectricity (μc/g) of the toner is calculated as shown by the following expression.

$$T\,(\mu c/g) = \frac{C \times V}{W_1 - W_2}$$

The image forming method and apparatus will be described with reference to FIGS. 2 to 5, taking as an example an image forming apparatus for developing a latent image formed on a negatively charged latent image bearing member, using a one-component developer comprising a positively chargeable magnetic toner. The image forming method and apparatus of the present invention may include not only those making use of the one-component developer but also those making use of the two-component developer.

Figure 3:
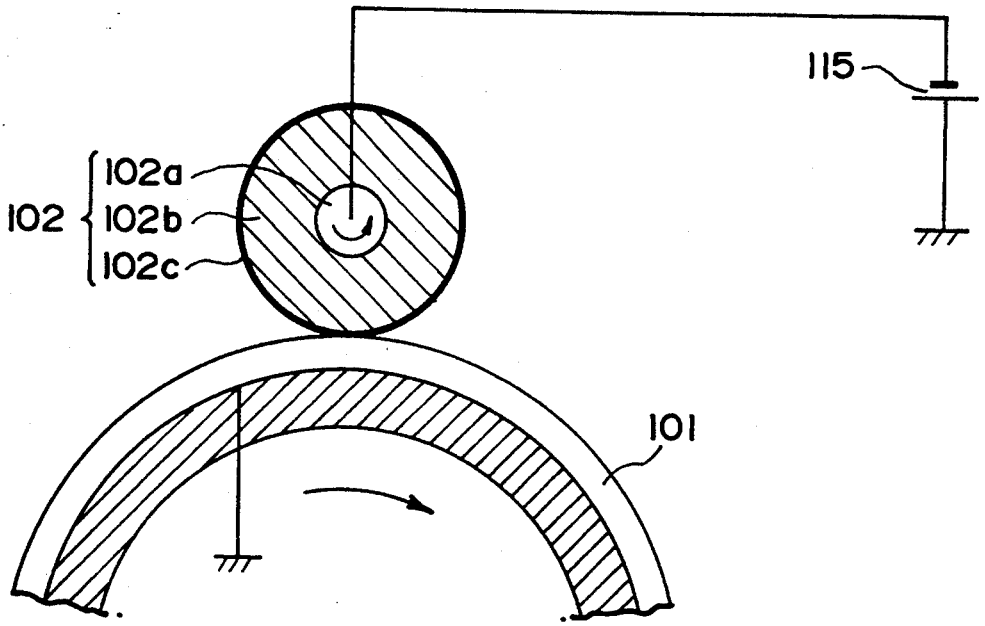
FIG. 3 schematically illustrates an example of the charging means of the present invention.

In FIG. 3, reference numeral 102 denotes a charging roller which is a charging means brought into contact with a latent image bearing member 101 at a given pressure, and is comprised of, as shown in FIG. 3, a metal mandrel **102*a*, a conductive rubber layer 102*b* provided thereon, and further provided on its external surface a surface layer 102*c*, a release film. The conductive rubber layer may preferably have a thickness of from 0.5 to 10 mm, and preferably from 1 to 5 mm. The surface layer 102*c* serves as a release film. It is preferred to provide this release film so that a softening agent can be prevented from exuding from the conductive rubber layer 102*b*** to the part at which the electrostatic image bearing member which is a chargeable member (photosensitive member) comes into contact. Hence, it becomes possible to prevent any smeared image from being caused by the photosensitive member turned to have a low resistance as a result of the adhesion of the softening agent to the photosensitive member, to prevent chargeability from being lowered by the filming of remaining toner to the photosensitive member, and also to prevent charge efficiency from being lowered.

Use of the conductive rubber layer in the charging roller also makes it possible to keep sufficient contact between the charging roller and the photosensitive member, and also causes no charge insufficiency.

The release film may preferably have a thickness of not more than 30 μm, and preferably from 10 to 30 μm. The lower limit of the thickness of the film may be smaller so long as no peel or turn-up may occur, and can be considered to be about 5 μm.

As materials for the release film, a nylon resin PVDF (polyvinylidene fluoride) and PVDC (polyvinylidene chloride) may be used. As materials for a photosensitive layer of the latent image bearing member 101, it is possible to use OPC, amorphous silicon, selenium or ZnO. In particular, in the case when the amorphous silicon is used in the photosensitive member, smeared images may seriously occur when even a slight quantity of the softening agent of the conductive rubber layer **102*b*** has been adhered to the photosensitive layer, compared with the case when other materials are used. Hence, it can be more effective to provide such an insulative coating on the outside of the conductive rubber layer.

It is one,of preferred embodiments that e.g., Hyndrin rubber that may undergo less environmental variations is formed between the conductive rubber layer and the release film surface layer so that leakage to the photosensitive member can be prevented.

Reference numeral 115 denotes a power source which applies a voltage to the charging roller 102, and supplies a given voltage to the metal mandrel **102*a* of the charging roller 102. Reference numeral 103 denotes a transferring charger serving as a transfer means. A given bias voltage is applied to the transferring charger from a constant-voltage power source 114**. As conditions for the bias, it is preferred for a current value to be from 0.1 to 50 μA and for a voltage value (absolute value) to be from 500 to 4,000 V.

The surface of the OPC photosensitive member which is the latent image bearing member 101 is, for example, negatively charged by the operation of the charging roller 102 serving as the charging means, having a powder source (voltage applying means 115, and the charged surface is exposed to light by optical image exposure as a latent image forming means 105 to form an electrostatic latent image. The latent image thus formed is developed using a positively chargeable toner-containing one-component developer 110 held in a developing assembly 109 equipped with a non-magnetic developing sleeve 104 serving as a developer carrying member in which a magnetic blade 111 made of iron and a magnet 140 are provided. The developing sleeve 104 is comprised of a stainless steel sleeve (SUS304) having a diameter of 50 mm and a plurality of traced concavities. In the developing zone, an AC bias, a pulse bias and/or a DC bias is/are applied across a conductive substrate of the latent image bearing member 101 and the developing sleeve 104 through a bias applying means 112. A transfer paper P is fed and delivered to a transfer zone, where the transfer paper P is electrostatically charged from its back surface (the surface opposite to the latent image bearing member) through a transfer charging assembly 103, so that the developed image (toner image) on the surface of the latent image bearing member 101 is electrostatically transferred to the transfer paper P. The transfer paper P separated from the latent image bearing member 101 is subjected to fixing using a heat-pressure roller fixing unit (thermal platen) 107 serving as a fixing means so that the toner image on the transfer paper P can be fixed.

The developer 110 remaining on the latent image bearing member 101 after the transfer step is removed by the operation of a cleaning assembly 108 having a cleaning blade. After the cleaning, the residual charges an the latent image bearing member 101 is eliminated by erase exposure 106, and thus the procedure again starting from the charging step using the contact charging assembly 102 is repeated.

Figure 2:
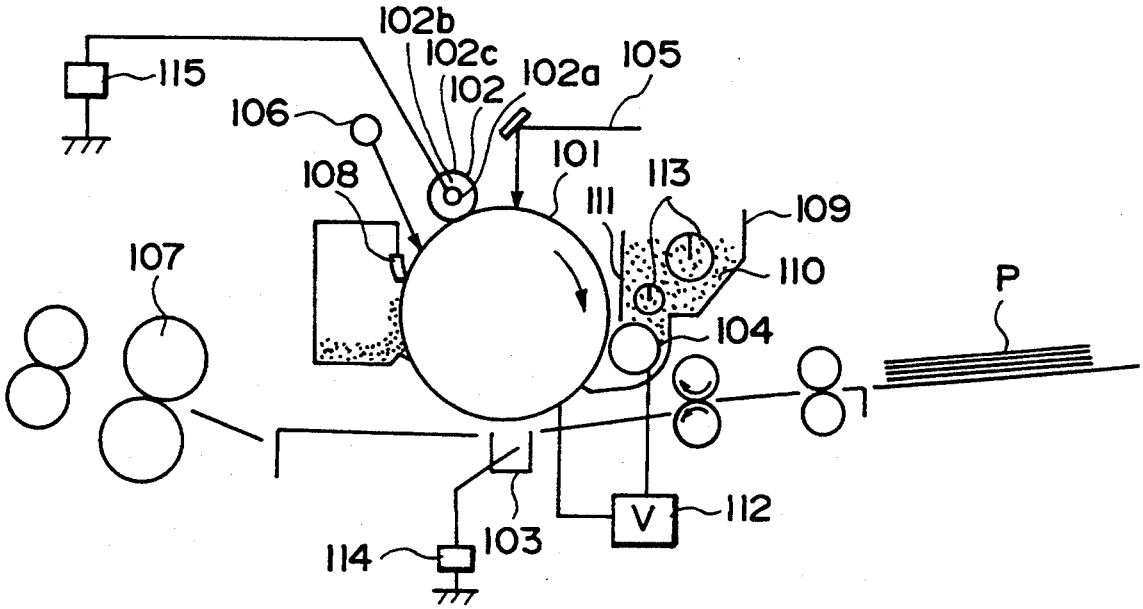
FIG. 2 schematically illustrates an example of the image forming apparatus of the present invention.
Figure 4:
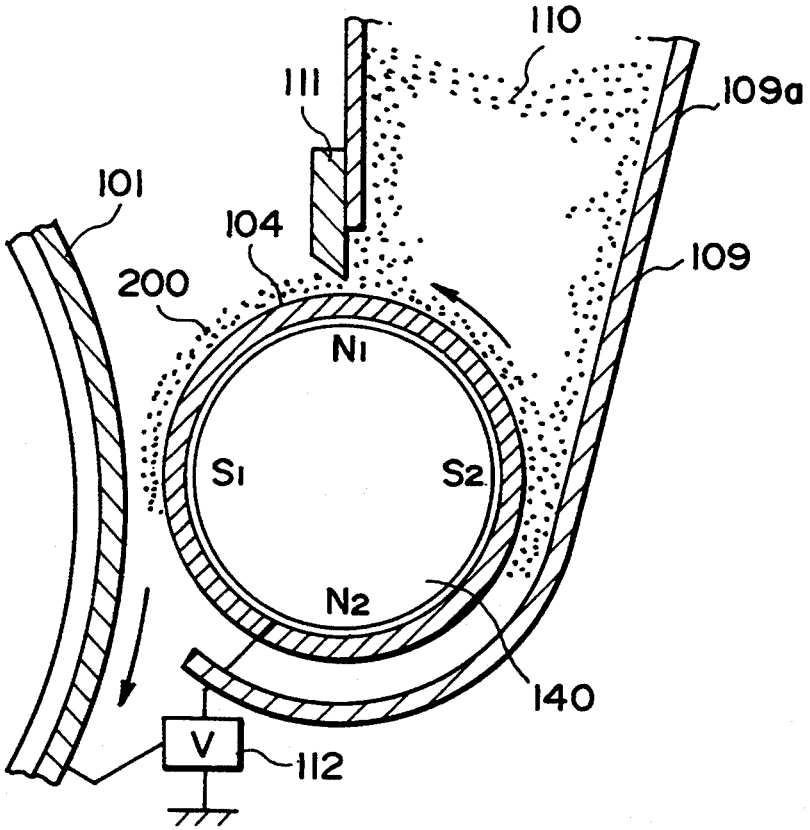
FIG. 4 is a partial enlarged view of the apparatus shown in FIG. 2 to illustrate a developing step.

FIG. 4 is a partially enlarged view of FIG. 2, to illustrate the developing step. The latent image bearing member 101 comprises the OPC photosensitive layer and the conductive substrate as previously described, and is rotated in the direction of an arrow. In the developing zone, the developing sleeve 104, a non-magnetic cylinder, which is the developer carrying member, is rotated so as to move in the same direction as the direction in which the latent image bearing member 101 is rotated. In the inside of the developing sleeve 104, a multi-polar permanent magnet 140 (magnet roll) serving as a magnetic field generating means is provided in a non-rotatable state. The multi-polar permanent magnet 140 is preferably set to have magnetic poles consisting of $N_1$: 500 to 900 gausses, $N_2$: 600 to 1,100 gausses, $S_1$: 800 to 1,500 gausses and $S_2$:400 to 800 gausses. The developer 110 held in the developing assembly 109 is coated on the surface of the developing sleeve 104, and, top example, plus triboelectric charges are imparted to the developer because of the friction between the surface of the sleeve 104 and the the developer 101. A magnetic doctor blade 111 made of iron is disposed in proximity (with a space of from 50 μm to 500 μm) to the surface of the cylinder and also opposingly to one of the magnetic pole positions of the multi-polar permanent magnet 140. Thus, the thickness of a toner layer 200 can be controlled to be small (from 30 μm to 300 μm) and uniform so that a toner layer smaller in thickness than the gap between the latent image bearing member 101 and developing sleeve 104 in the developing zone can be formed in a non-contact state. The rotational speed of this developing sleeve 104 is regulated so that the peripheral speed of the sleeve can be substantially equal or close to the speed of the peripheral speed of the latent image bearing member 101. As the magnetic doctor blade 111, a permanent magnet may be used in place of iron to form an opposing magnetic pole. In the developing zone, the AC bias or pulse bias may be applied through the bias means 112, across the developing sleeve 104 and the surface of the latent image bearing member 101. As bias conditions, the AC bias may preferably have a Vpp of from 1,500 to 2,300 V and a frequency (f) of from 900 to 1,600 Hz, and the DC bias, a DC of from −100 to −350 V.

When the developer 110 is moved in the developing zone formed at the part the developing sleeve (the developer carrying member) 104 and the latent image bearing member 101 become closest and in the vicinity thereof, the developer 110 is moved to the side of the latent image bearing member 101 in a to-and-fro movement between the developing sleeve 104 and the latent image bearing member 101 by the electrostatic force of the electrostatic image bearing member surface of the latent image bearing member 101 and the action of the AC bias or pulse bias.

In place of the magnetic doctor blade 111, an elastic blade formed of an elastic material such as silicone rubber may be used so that the layer thickness of the toner layer 200 can be controlled by pressing it against the surface of the latent image bearing member 101 and the toner layer having a given thickness may be formed on the developing sleeve 104.

As for the photosensitive layer of the latent image bearing member 101, the OPC photosensitive member or drum may be replaced with an insulating drum for electrostatic recording or a photoconductive drum having a layer of a photoconductive insulating material such as α-Se, CdS, $ZnO_2$ or α-Si, any of which can be appropriately selected and used according to developing conditions.

Figure 5:
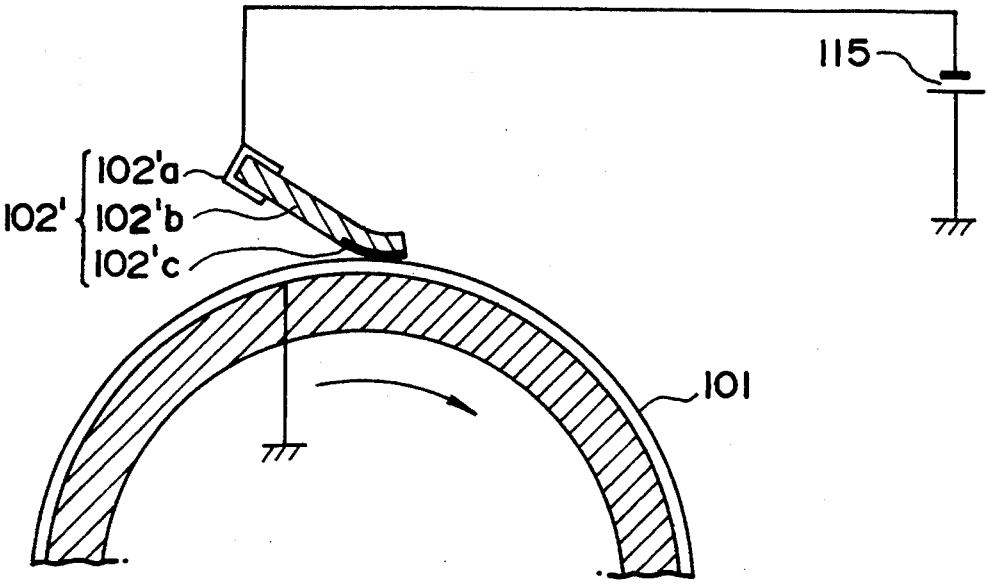
FIG. 5 schematically illustrates another example of the charging means of the present invention.

FIG. 5 illustrates another embodiment of the charging means that can be used in place of the charging roller shown in FIG. 3. This charging means comprises a blade-shaped contact charging member 102'. This blade-shaped contact charging member 102' also has the same layers structure as the charging roller 102, and is comprised of a holding metal member **102'*a* to which a voltage is applied, a conductive rubber member 102'*b* supported by the holding metal member 102'*a*, and a surface layer 102'*c* serving as the release film, provided at the part where the conductive rubber layer 102'*b* comes into contact with the latent image bearing member 101. This embodiment can give the same Operation and effect as the charging roller 102**.

In the examples described above, the roller-shaped or blade-shaped member is used as the charging member. Without limitation thereto, the present invention can also be carried out using a member with a different shape.

The charging means 102 described above can also be used as a transfer means by bringing it into contact with the latent image bearing member 101 in the state the transfer paper P is held between them.

In the image forming method and apparatus described above, a commonly available charging device which causes the surface of the latent image bearing member 101 to be statically charged by corona charging can also be used in place of the charging means for negatively (or positively) charging the surface of the latent image bearing member 101.

In the case when the corona charging means is used, ozone is generated in a large quantity, and hence it is prefer: red to provide an ozone filter or the like.

Figure 6:
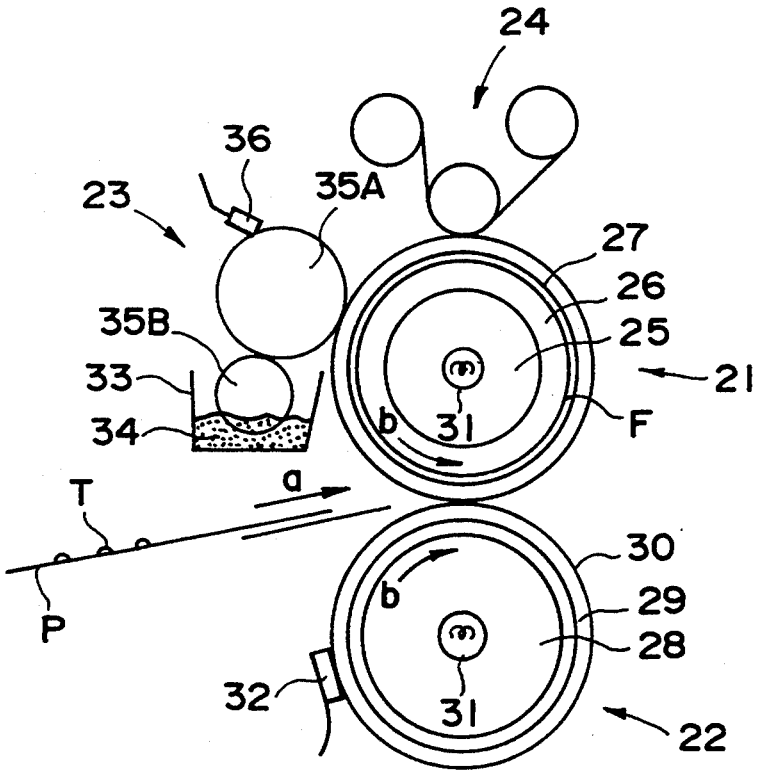
FIG. 6 schematically illustrates an example of the fixing means of the present invention.

FIG. 6 illustrates a toner image fixing apparatus for fixing to a transfer medium the unfixed toner image on the transfer medium by the action of heat and pressure.

The toner image fixing method of the present invention will be described below with reference to the toner image fixing apparatus shown in FIG. 6.

The toner image fixing apparatus is provided with fixing rotating members comprised of a fixing roller 21 formed into a roller and a pressure roller 22 opposingly disposed thereto; a release agent coating means 23 for coating a release agent, silicone oil, on the fixing roller 21; and a cleaning means 24 for cleaning the fixing roller 21.

The fixing roller 21 comprises a mandrel 25 made of aluminum, serving as a substrate, and formed thereon an elastic: layer 26 comprised of HTV silicone rubber (high-temperature vulcanization silicone rubber). On the elastic layer 26, an oil-resistent layer F comprised of fluorine rubber is formed, and further formed thereon an anti-offset layer 27 comprised of RTV silicone rubber (room-temperature vulcanization silicone rubber). This is made to have an outer diameter of, for example, 60 ϕ.

The pressure roller 22 comprises a mandrel 28 made of aluminum and formed thereon an elastic layer 29 comprised of HTV silicone rubber. On the elastic layer 29, a resin layer 30 comprised of fluorine resin is formed. This roller is similarly made to have an outer diameter of, for example, 60 ϕ.

In the mandrel 25 of the fixing roller 21 and the mandrel 28 of the pressure roller 22 each, a halogen heater 31 is provided. The temperature of the pressure roller 22 is detected with a thermistor 32 provided in contact with the roller to control the on-off of the halogen heater 31 so that the temperatures of the fixing roller 21 and pressure roller 22 can be kept constant at about 150° C.

The release agent coating means 23 is so designed that a silicone oil 34 with a viscosity of 300 cSt, held in a container 33, is drawn up with upper and lower feed rollers 35A and 35B, and then coated on the anti-offset layer 27 of the fixing roller 21. The quantity of coating of the silicone oil onto the anti-offset layer 27 is controlled by the contact angle and pressure of an oil feed adjusting blade 36.

The cleaning means 24 removes toner having offset on the anti-offset layer 27 of the fixing roller 21.

The fixing apparatus as described above operates in the following way: A transfer medium P bearing in laminae plurality of unfixed toner images T (with different Colors) is transported in the direction of an arrow a by means of a transport apparatus (not shown). The transfer medium P is made to pass through the fixing roller 21 and pressure roller 22 that rotate in the directions of arrows b by means of a drive apparatus (not shown), while being held between the rollers, so that the toner images T in laminae is color-mixed on and heat-fixed to the transfer medium to form a full-color image.

As previously described, the fixing roller 21 has an oil-resistent layer comprised of fluorine rubber.

This oil-resistent layer prevents the silicone oil from permeating into the HTV silicone rubber of the lower layer, and thus prevents the roller from being swelled with the oil.

In the RTV silicone rubber of the oil-resistent layer, the silicone oil is retained to give a high releasability.

Use of the roller having an intermediate layer as the oil-resistent layer like this has caused problems such that a stress is produced between the layers of the fixing roller 21 because of the heat and pressure applied during fixing and the slippage occurring between the fixing roller and pressure roller, to cause separation of layers between the oil-resistent layer and the anti-offset layer, so that the roller can not be used for a long period of time.

In the present invention, how to cope with the problems as stated above was studied. It was discovered that the, above problems can be solved and a good image fixing method can be provided when a toner image fixing apparatus constituted as described below is used.

That is, the apparatus is a fixing apparatus comprising a pair of rollers opposingly brought into pressure contact, between and through which a transfer medium bearing a toner image is held and transported to carry out fixing, and a coating means for coating a release agent on at least one of said pair of rollers; wherein at least one of said pair of rollers comprises a roller substrate, an elastic layer provided on the roller substrate, an oil-resistent layer provided on the elastic layer and an anti-offset layer serving as a surface layer provided on the oil-resistent layer, and these layers have an elongation that is larger by degrees in order of the anti-offset layer, the oil-resistant layer and the elastic layer.

The constitution of the image fixing apparatus of the present invention will be specifically described below.

The fixing roller 21 comprises the mandrel 25 made of aluminum, serving as a substrate, and formed thereon the elastic layer 26 comprised of methylphenyl HTV silicone rubber. On the elastic layer 26, the oil-resistent layer F comprised of fluorine rubber is formed, and further formed on the oil-resistent layer F the anti-offset layer 27 comprised of RTV silicone rubber.

In the above elastic layer 26, various kinds of materials can be used. The methylphenyl HTV silicone rubber is suitable because of its excellent tensile strength, thermal conductivity, elasticity and adhesion to the mandrel 25. Preferably a methylphenyl HTV silicone rubber with a high thermal conductivity should be used. Providing the elastic layer 26 having a high thermal conductivity makes it possible to rapidly supply the heat to the surface of the fixing roller 21, to prevent the surface temperature of the fixing roller 21 from being lowered during the pass of the transfer medium P, and to fix at a stable temperature the unfixed toner image T beared on the transfer medium P.

In particular, in the fixing of full-color images, the surface temperature of the fixing roller 21 greatly affect the color mixture of toners, and the variations of surface temperature have an influence which causes changes in color tones of the color image. Hence, it is particularly preferred to form the elastic layer 26 with use of the methylphenyl HTV silicone rubber with a high thermal conductivity.

In the present example, the elastic layer 26 is made to have a thermal conductivity of $0.5\times10^{-3}$ cal/cm.sec.°C. More preferably, it should have a thermal conductivity of $1.0\times10^{-3}$ cal/cm.sec.°C.

The oil-resistent layer F comprised of fluorine rubber is formed after the coating of a primer on the elastic layer 26. The oil-resistent layer F should have a thickness of from 5 to 300 μm. An oil-resistent layer F with a thickness less than 5 μm gives a possibility that the elastic layer 2 beneath it is partially uncovered because of coating uneveness of the fluorine rubber, making it imperfect for the oil-resistent layer F to prevent the silicone oil from permeating into the elastic layer 26. On the other hand, an oil resistent layer F with a thickness more than 300 μm may bring about an increase in the hardness of the whole fixing roller 21, or, because of a large amount of heat distortion of the fluorine rubber, may cause a deformation of the nip portion between the fixing roller 21 and pressure roller 22 when the former is stopped for a long period of time. Thus, the oil-resistent layer F may preferably have a thickness ranging from 5 to 300 μm, and more preferably from 8 to 100 μm.

The anti-offset layer 27 is formed on the oil-resistent layer F after optional coating of a primer. The anti-offset layer 27 may preferably be formed of a material having a good wettability to the release agent, silicone oil. Besides the RTV silicone rubber, it is also possible to use LTV silicone rubber (low-temperature vulcanization silicone rubber). The RTV silicone rubber may be of either one-part type or two-part type. Preferably one-part type RTV silicone rubber should be used, for the reason that the one-part type RTV silicone rubber has an adhesion to an adherent prior to its vulcanization and also can finally give a strong adhesion to the oil-resistent layer F of the anti-offset layer 27. In this anti-offset layer 27, a filler such as silica or red iron oxide may be appropriately mixed.

The anti-offset layer 27 should be formed by a method in which a ;rubber such as LTV silicone rubber or RTV silicone rubber is coated by knife coating or spray coating. This is because, when it is coated by knife coating or spray coating, the coated RTV silicone rubber or the free liquid surface of the rubber such as RTV silicone rubber enables ready formation of the anti-offset layer 27 as a thin layer, and a production unit for forming the anti-offset layer 25 can readily set up, so that a superior mass productivity of the fixing roller 21 can be attained. The releasability Of the anti-offset layer 27 can also be made stable.

As described above, the anti-offset layer 27 is formed on the oil-resistent layer F after optional coating of a primer. As the primer, a primer comprised of a silane coupling agent may be used which has been hitherto commonly used for the adhesion of rubbers. It is also possible to use a silicone varnish primer, a mixture of silicone varnish and silicone rubber, or a primer comprised of a block copolymer silicone varnish.

It is ideal for each layer of the fixing roller 21 to have an elongation set as follows:

| | |
|---|---|
| Elastic layer 26: | 250% |
| Oil-resistent layer F: | 300% |
| Anti-offset layer 27: | 500% |

The values of elongation of rubber can be measured by measuring the elongation according to the vulcanized rubber physical test method as prescribed in JIS K6301.

Making the elongation larger by degrees toward the surface layer side that is more affected by the deformation of the roller, i.e., making the elongation lager by degrees in order of the anti-offset layer 27, the oil-resistant layer F and the elastic layer 26 can bring about a great decrease in the stress at each boundary between layers and also a great improvement in the running lifetime until the separation occurs at any boundary between the layers of the fixing roller.

The present invention can give the developer comprising the toner that makes use of the specific AB-type block copolymer as a binder resin, achieves both the high-temperature anti-offset properties attributable to the segment-A and the low-temperature fixing performance attributable to the segment-B, and is suited for the heat fixing method; and also can give the image forming method, toner image fixing method and image forming apparatus making use of such a developer.

The present invention will be described below in detail by giving Examples. In the following, "part(s)" refers to "part(s) by weight".

Resin Preparation Example 1

First-stage Polymerization

| | |
|---|---|
| Styrene | 400 parts |
| n-Butyl acrylate | 200 parts |
| Polymerization initiator represented by the following structural formula (I) | 50 parts |
| Formula (I) | |

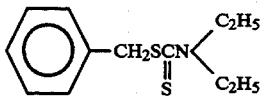

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl acrylate copolymer (Tg: 32° C.) with a number average molecular weight (Mn) of 2,500 and a weight average molecular weight (Mw) of 5,100 was obtained.

Second-stage Polymerization

In the reaction vessel after the first-stage polymerization, 720 parts by weight of styrene, 480 parts by weight of n-butyl methacrylate and 1,500 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 600 parts |
| Styrene | 720 parts |
| n-Butyl methacrylate | 480 parts |
| Toluene | 2,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,200, Mw was 12,500 and Tg was 57° C. The AB-type block copolymer obtained here is designated as resin A.

Resin Preparation Examples 2 to 6

Resins B, C, D, E and F were prepared in the same manner as in Resin Preparation Example 1 except for changing monomer let compositional proportions and reaction conditions. Properties of resins A to F are shown in Table 1.

TABLE 1

| | First-stage polymer | | | AB type block copolymer | | |
|---|---|---|---|---|---|---|
| | Molecular weight | | Tg | Molecular weight | | Tg |
| Resin | Mn | Mw | (°C.) | Mn | Mw | (° C.) |
| A | 2,500 | 5,100 | 32 | 6,200 | 12,500 | 57 |
| B | 2,500 | 5,200 | 33 | 6,000 | 12,600 | 55 |
| C | 7,000 | 14,500 | 40.0 | 16,000 | 38,000 | 60 |
| D | 6,800 | 14,000 | 45.5 | 18,000 | 42,000 | 45.5<br>62.0 |
| E | 3,000 | 6,200 | 40.0 | 7,000 | 15,000 | 47.0 |
| F | 6,300 | 12,500 | 41.0 | 17,000 | 40,000 | 41.0<br>70.0 |

Comparative Resin Preparation Examples 1 & 2

TABLE 2

| | Comparative Resin Preparation Example | |
|---|---|---|
| | 1 | 2 |
| Styrene | 435 parts | 400 parts |
| n-Butyl acrylate | 45 parts | 60 parts |
| n-Butyl methacrylate | 120 parts | 140 parts |
| Benzoyl peroxide | 10 parts | 5 parts |
| Toluene | 500 parts | 500 parts |

Using the materials for Comparative Resin Preparation Examples 1 and 2 as shown in the above Table 2, commonly known solution polymerization was carried out to give random copolymer g with Mn of 12,000, Mw of 29,000 and Tg of 59° C. and random copolymer h with Mn of 25,000, Mw of 78,000 and Tg of 62° C., respectively.

The random copolymer g thus obtained is designated as resin G, and the random copolymer h as resin H.

Example 1

| | |
|---|---|
| Resin A of Resin Preparation Example 1 | 100 parts |
| Chromium complex of di-tert-butylsalicylic acid | 4.0 parts |
| Copper phthalocyanine pigment having the structure represented by structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 120° C. to 210° C.

Using the above two-component developer, image reproduction was tested with use of CLC-500.

As a result, no offset to the fixing roller occurred at all even after running on 10,000 sheets in the monochromatic mode, and full-color images free from fogging and with reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Examples 2, 3, & Comparative Example 1

Two-component developers were prepared in the same manner as in Example 1 except that the resin A was replaced with resins B, E and F, respectively. The tests were carried out in the same way.

Results obtained in Examples 1 to 3 and Comparative Example 1 are shown in Table 3.

TABLE 3

| | Resin | Color mixing temperature range | Running sheet number: Offset to fixing roll | (1) | (2) | (3) | (4) |
|---|---|---|---|---|---|---|---|
| Example: | | | | | | | |
| 1 | A | 115–195° C. | 10,000sh.:AB | A | A | A | A |
| 2 | B | 110–190° C. | 10,000sh.:AB | A | A | A | A |
| 3 | E | 110–180° C. | 10,000sh.:AB | A | A | A | AB |
| Comparative Example: | | | | | | | |
| 1 | G | 160–185° C. | 2,000sh.*:C | AB | A | AB | A |

(1): Color reproduction
(2): Transport performance
(3): Light transmission properties
(4): Blocking resistance
*Offset occurred.
Remarks:
Evaluation was made according to five rank system (A, AB, B, BC, C: from "good" to "poor").

Example 4

| | |
|---|---|
| Resin C of Resin Preparation Example 3 | 100 parts |
| Magnetic iron oxide | 70 parts |
| Nigrosine | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was added as a fluidity improver. A one-component developer was thus prepared.

Using the one-component developer thus prepared, unfixed images were obtained with use of a copier NP-4835, manufactured by Canon Inc., and were tested for their fixing performance using an external fixing machine. As a result, fixing was possible in a fixing temperature range of from 130° C. to 220° C.

Using the above one-component developer and the copier, image reproduction was tested. As a result, no offset to the fixing roller occurred at all even after running on 10,000 sheets, and good images free from fogging and black spots around line images were obtained.

Blocking resistance was also good similarly to that in Example 1.

Examples 5, 6, & Comparative Example 2

One-component developers were prepared in the same manner as in Example 4 except that the resin C was replaced with resins D, F and G, respectively. The tests were carried out in the same way.

Results obtained in Examples 4 to 6 and Comparative Example 2 are shown in Table 4.

TABLE 4

| | Fixing | Running sheet number: |
|---|---|---|

TABLE 4-continued

| | Resin | temperature range | Offset to fixing roll | Fogging | Blocking resistance |
|---|---|---|---|---|---|
| Example | | | | | |
| 4 | C | 130–220° C. | 10,000sh.:AB | AB | A |
| 5 | D | 120–220° C. | 10,000sh.:AB | AB | A |
| 6 | F | 120–200° C. | 10,000sh.:AB | AB | AB |
| Comparative Example: | | | | | |
| 2 | H | 185–220° C. | 5,000sh.:C | AB | A |

Resin Preparation Example 7

First-stage Polymerization

| | |
|---|---|
| Styrene | 382 parts |
| n-Butyl acrylate | 200 parts |
| Monobutyl maleate | 18 parts |
| Polymerization initiator represented by the following structural formula (I) | 50 parts |
| Formula (I) | |

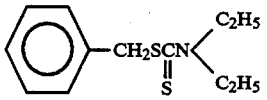

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl methacrylate/monobutyl maleate copolymer (Tg: 32° C.) with a number average molecular weight (Mn) of 2,100 and a weight average molecular weight (Mw) of 4,900 was obtained.

Second-Stage Polymerization

In the reaction vessel after the first-stage polymerization, 684 parts by weight of styrene, 480 parts by weight of n-butyl methacrylate, 36 parts by weight of monobutyl maleate and 1,500 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 600 parts |
| Styrene | 684 parts |
| n-Butyl methacrylate | 480 parts |
| Monobutyl maleate | 36 parts |
| Toluene | 2,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,100, Mw was 10,700 and Tg was 58° C. The AB-type block copolymer obtained here is designated as resin I.

Resin Preparation Examples 8 to 12

Resins J, K, L, M and N were prepared in the same manner as in Resin Preparation Example 7 except for changing monomer compositional proportions and reaction conditions.

Properties of resins I to N are shown in Table

TABLE 5

| | First-stage polymer | | | Amount of acid (% by weight) (based on block copolymer) | | (AB)n-type block copolymer | | | |
|---|---|---|---|---|---|---|---|---|---|
| | Molecular weight | | | | | Molecular weight | | | |
| Resin | Mn | Mw | Tg (°C.) | Segment A | Segment B | Mn | Mw | n | Tg (°C.) |
| I | 2,100 | 4,900 | 32 | M.M.B. 0.09 | M.M.B. 2.0 | 6,100 | 11,700 | 1 | 58.0 |
| J | 2,500 | 5,100 | 33 | A.A. 10.0 | 0 | 5,500 | 12,000 | 1 | 57.0 |
| K | 6,000 | 14,000 | 40.0 | M.M.B. 5.0 | M.M.B. 2.5 | 15,000 | 32,000 | 1 | 60.0 |
| L | 6,800 | 15,000 | 48.0 | 0 | A.A. 10.0 | 18,000 | 39,000 | 1 | 48.0<br>61.5 |
| M | 4,000 | 7,000 | 50 | 0 | 0 | 6,500 | 12,200 | 1 | 55.0 |
| N | 6,200 | 13,000 | 47 | 0 | 0 | 17,000 | 39,000 | 1 | 47.0<br>70.0 |

M.M.B.: Monobutyl maleate
A.A.: Acrylic acid

Comparative Resin Preparation Examples 3 & 4

TABLE 6

| | Comparative Resin Preparation Example | |
|---|---|---|
| | 3 | 4 |
| Styrene | 370 parts | 360 parts |
| n-Butyl acrylate | 60 parts | 60 parts |
| n-Butyl methacrylate | 140 parts | 140 parts |
| Acrylic acid | 30 parts | 40 parts |
| Benzoyl peroxide | 10 parts | 5 parts |
| Toluene | 500 parts | 500 parts |

Using the materials for Comparative Resin Preparation Examples 3 and 4 as shown in the above Table 6, commonly known solution polymerization was carried out to give random copolymer o with Mn of 10,500, Mw of 24,000 and Tg of 58.5° C. and random copolymer p with Mn of 27,000, Mw of 73,000 and Tg of 63° C., respectively.

The random Copolymer o thus obtained is designated as resin O, and the random copolymer p as resin P.

Example 7

| | |
|---|---|
| Resin I of Resin Preparation Example 7 | 100 parts |
| Chromium complex of di-tert-butylsalicylic acid | 4.0 parts |
| Copper phthalocyanine pigment having the structure represented by structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 120° C. to 235° C.

Using the above two-component developer, image reproduction was tested with use of CLC-500.

As a result, no offset to the fixing roller occurred at all even after running on 10,000 sheets in the monochromatic mode, and full-color images free from fogging and with reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Example 8

A two-component developer was prepared in the same manner as in Example 1 except that the resin I was replaced with resin J. The tests were carried out in the same way.

Results obtained in Examples 7 and 8 are shown in Table 7.

Example 9

| | |
|---|---|
| Resin I of Resin Preparation Example 7 | 100 parts |
| Charge control agent represented by the structural formula (2) | 2 parts |
| Carbon black (particle diameter: 60 mμ) | 3.5 parts |

A two-component developer was prepared in the same manner as in Example 7 except that the above materials were used. The tests were carried out in the same way.

Example 10 and Comparative Example 3

Two-component developers were prepared in the same manner as in Example 9 except that the resin I was replaced with resins M and O, respectively. The tests were carried out in the same way.

Results obtained in Examples 9 and 10 and Comparative Example 3 are shown in Table 7.

TABLE 7

| | Resin | Color mixing temperature range | Running sheet number: Offset to fixing roll | (1) | (2) | (3) | (4) |
|---|---|---|---|---|---|---|---|
| Example: | | | | | | | |
| 7 | I | 120–235° C. | 10,000sh.:A | A | A | A | A |
| 8 | J | 115–220° C. | 10,000sh.:A | A | A | A | A |
| 9 | I | 120–215° C. | 10,000sh.:A | — | A | — | A |
| 10 | M | 110–180° C. | 10,000sh.:A | A | A | A | A |
| Comparative Example: | | | | | | | |
| 3 | O | 145–170° C. | 3,000sh.*:C | AB | A | AB | AB |

(1): Color reproduction
(2): Transport performance
(3): Light transmission properties
(4): Blocking resistance
*Offset occurred.
Remarks:
Evaluation was made according to five rank system (A, AB, B, BC, C: from "good" to "poor").

Example 11

| | |
|---|---|
| Resin K of Resin Preparation Example 9 | 100 parts |
| Magnetic iron oxide | 70 parts |
| Chromium complex of di-tert-butylsalicylic acid | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of negatively chargeable dry process silica powder having been made hydrophobic was added as a fluidity improver. A one-component developer was thus prepared.

Using the one-component developer thus prepared, unfixed images were obtained with use of a copier NP-270, manufactured by Canon Inc., and were tested for their fixing performance using an external fixing machine. As a result, fixing was possible in a fixing temperature range of from 130° C. to 230° C.

Using the above one-component developer and the copier, image reproduction was tested. As a result, no offset to the fixing roller occurred at all even after running on 10,000 sheets, and good images free from fogging and black spots around line images were obtained.

Blocking resistance was also good similarly to that in Example 7.

Examples 12, 13, & Comparative Example 4

One-component developers were prepared in the same manner as in Example 11 except that the resin K was replaced with resins L, N and P, respectively. The tests were carried out in the same way.

Results obtained in Examples 11 to 13 and Comparative Example 4 are shown in Table 8.

TABLE 8

| | Resin | Fixing temperature range | Running sheet number: Offset to fixing roll | Fogging | Blocking resistance |
|---|---|---|---|---|---|
| Example: | | | | | |
| 11 | K | 130–230° C. | 10,000sh.:A | A | A |
| 12 | L | 120–230° C. | 10,000sh.:A | A | A |
| 13 | N | 135–200° C. | 10,000sh.:AB | AB | AB |
| Comparative Example: | | | | | |
| 4 | P | 165–185° C. | 1,000sh.:C | AB | A |

Resin Preparation Example 13

First-stage Polymerization

| | |
|---|---|
| Styrene | 400 parts |
| n-Butyl acrylate | 200 parts |
| Polymerization initiator represented by the following structural formula (I) | 50 parts |
| Formula (I) | |

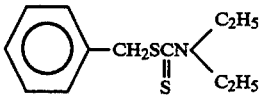

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl acrylate copolymer (Tg: 32° C.) with a number average molecular weight (Mn) of 2,500 and a weight average molecular weight (Mw) of 5,100 was obtained.

Second-stage Polymerization

In the reaction vessel after the first-stage polymerization, 720 parts by weight of styrene, 480 parts by weight of n-butyl methacrylate and 1,500 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 600 parts |
| Styrene | 720 parts |
| n-Butyl methacrylate | 480 parts |
| Toluene | 2,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,200, Mw was 12,500 and Tg was 57° C. The AB-type block copolymer obtained here is designated as resin Q.

Resin Preparation Examples 14 to 18

Resins R, S, T, U and V were prepared in the same manner as in Example 13 except for changing monomer compositional proportions and reaction conditions.

Properties of resins Q to v are shown in Table 9.

TABLE 9

| | First-stage polymer | | | Amount of acid (% by weight) (based on block copolymer) | | (AB)n-type block copolymer | | | |
|---|---|---|---|---|---|---|---|---|---|
| | Molecular weight | | | | | Molecular weight | | | |
| Resin | Mn | Mw | Tg (°C.) | Segment A | Segment B | Mn | Mw | n | Tg (°C.) |
| Q | 2,300 | 5,300 | 33 | M.M.B. 1.5 | M.M.B. 5.0 | 6,100 | 12,500 | 1 | 55.0 |
| R | 2,500 | 5,200 | 34 | A.A. 7.5 | 0 | 6,400 | 13,000 | 1 | 56.5 |
| S | 4,000 | 11,000 | 37 | M.M.B. 5.0 | M.M.B. 5.0 | 13,000 | 27,000 | 1 | 61.2 |
| T | 5,000 | 12,000 | 47.5 | 0 | A.A. 2.0 | 16,000 | 35,000 | 1 | 47.5 60.0 |
| U | 4,000 | 6,800 | 45 | 0 | 0 | 7,000 | 15,000 | 1 | 50 |
| V | 6,000 | 14,000 | 45 | 0 | 0 | 16,000 | 33,000 | 1 | 45 75 |

M.M.B.: Monobutyl maleate
A.A.: Acrylic acid

Comparative Resin Preparation Examples 5 & 6

TABLE 10

| | Comparative Resin Preparation Example 5 | 6 |
|---|---|---|
| Styrene | 435 parts | 400 parts |
| n-Butyl acrylate | 45 parts | 60 parts |
| n-Butyl methacrylate | 120 parts | 140 parts |
| Benzoyl peroxide | 10 parts | 5 parts |
| Toluene | 500 parts | 500 parts |

Using the materials for Comparative Resin Preparation Examples 5 and 6 as shown in the above Table 10, commonly known solution polymerization was carried out to give random copolymer w with Mn of 12,000, Mw of 29,000 and Tg of 59° C. and random copolymer x with Mn of 25,000, Mw of 78,000 and Tg of 62° C., respectively.

The random copolymer w thus obtained is designated as resin W, and the random copolymer x as resin X.

Example 14

| | |
|---|---|
| Resin Q of Resin Preparation Example 13 | 100 parts |
| Chromium complex of di-tert-butylsalicylic acid | 4.0 parts |
| Copper phthalocyanine pigment having the structure represented by structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 120° C. to 210° C.

Using the above two-component developer, image reproduction was tested with use of CLC-500.

As a result, no offset to the fixing roller occurred at all even after running on 10,000 sheets in the monochromatic mode, and full-color images free from fogging and with reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Examples 15, 16, & Comparative Example 5

Two-component developers were prepared in the same manner as in Example 14 except that the resin Q was replaced with resins R, V and W, respectively. The tests were carried out in the same way.

Example 17

| | |
|---|---|
| Resin Q of Resin Preparation Example 13 | 100 parts |
| Azo-type chromium complex having the structure represented by the structural formula (2) | 2 parts |
| Carbon black (particle diameter: 60 mμ) | 3.5 parts |

A two-component developer was prepared in the same manner as in Example 14 except that the above materials were used. The tests were carried out in the same way.

Results obtained in Examples 14 to 17 and Comparative Example 5 are shown in Table 11.

TABLE 11

| | Resin | Color mixing temperature range | Running sheet number: Offset to fixing roll | (1) | (2) | (3) | (4) |
|---|---|---|---|---|---|---|---|
| Example: | | | | | | | |
| 14 | Q | 120–215° C. | 10,000 sh.: A | A | A | A | A |
| 15 | R | 120–220° C. | 10,000 sh.: A | A | A | A | A |
| 16 | U | 110–180° C. | 10,000 sh.: AB | A | A | A | A |
| 17 | Q | 120–215° C. | 10,000 sh.: A | — | A | — | A |
| Comparative Example: | | | | | | | |
| 5 | W | 150–170° C. | 2,000 sh.*: C | AB | A | AB | AB |

(1): Color reproduction
(2): Transport performance
(3): Light transmission properties
(4): Blocking resistance
*Offset occurred.
Remarks:
Evaluation was made according to five rank system (A, AB, B, BC, C: from "good" to "poor").

Example 18

| | |
|---|---|
| Resin S of Resin Preparation Example 15 | 100 parts |
| Magnetic iron oxide | 70 parts |
| Nigrosine | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was added as a fluidity improver. A one-component developer was thus prepared.

Using the one-component developer thus prepared, unfixed images were obtained with use of a copier NP-4835, manufactured by Canon Inc., and were tested for their fixing performance using an external fixing machine. As a result, fixing was possible in a fixing temperature range of from 130° C. to 220° C.

Using the above one-component developer and the copier, image reproduction was tested. As a result, no offset to the fixing roller occurred at all even after running on 10,000 sheets, and good images free from fogging and black spots around line images were obtained.

Blocking resistance was also good similarly to that in Example 14.

Examples 19, 20, & Comparative Example 6

One-component developers were prepared in the same manner as in Example 17 except that the resin S was replaced with resins T, V and X, respectively. The tests were carried out in the same way.

Results obtained in Examples 18 to 20 and Comparative Example 6 are shown in Table 12.

TABLE 12

| | Resin | Fixing temperature range | Running sheet number: Offset to fixing roll | Fogging | Blocking resistance |
|---|---|---|---|---|---|
| Example: | | | | | |
| 18 | S | 130–220° C. | 10,000 sh.: A | A | A |
| 19 | T | 120–220° C. | 10,000 sh.: A | A | A |
| 20 | V | 140–190° C. | 10,000 sh.: AB | AB | AB |
| Comparative Example: | | | | | |
| 6 | X | 185–220° C. | 5,000 sh.: C | AB | A |

Resin Preparation Example 19

First-stage Polymerization

| | |
|---|---|
| Styrene | 190 parts |
| n-Butyl methacrylate | 360 parts |
| Monobutyl maleate | 50 parts |
| Polymerization initiator represented by the following structural formula (I) | 50 parts |
| Formula (I) | |

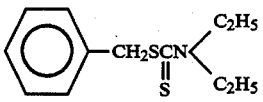

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl methacrylate/monobutyl maleate copolymer (Tg: 33° C.) with a number average molecular weight (Mn) of 1,900 and a weight average molecular weight (Mw) of 3,900 was obtained.

Second-stage Polymerization

In the reaction vessel after the first-stage polymerization, 612 parts by weight of styrene, 480 parts by weight of n-butyl methacrylate, 108 parts by weight of monobutyl maleate and 1,500 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 600 parts |
| Styrene | 612 parts |
| n-Butyl methacrylate | 480 parts |
| Monobutyl maleate | 108 parts |
| Toluene | 2,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,200, Mw was 13,000 and Tg was 57° C. The AB-type block copolymer obtained here is designated as resin YA.

Resin Preparation Examples 20 to 24

Resins YB, YC, YD, YE and YF were prepared in the same manner asin Resin Preparation Example 19 except for changing monomer compositional proportions and reaction conditions.

Properties of resins YA to YF are shown in Table 13.

TABLE 13

| | First-stage polymer | | | Amount of acid (% by weight) (based on block copolymer) | | (AB)n-type block copolymer | | | |
|---|---|---|---|---|---|---|---|---|---|
| | Molecular weight | | Tg | Segment | Segment | Molecular weight | | | Tg |
| Resin | Mn | Mw | (°C.) | A | B | Mn | Mw | n | (°C.) |
| YA | 1,900 | 3,900 | 33 | M.M.B. 2.6 | M.M.B. 6.0 | 6,200 | 13,000 | 1 | 57.0 |
| YB | 2,500 | 5,100 | 40 | A.A. 10.0 | 0 | 5,900 | 12,000 | 1 | 56.0 |
| YC | 5,000 | 10,000 | 40.0 | M.M.B. 4.5 | M.M.B. 3.5 | 12,000 | 25,000 | 1 | 60.0 |
| YD | 5,200 | 14,000 | 43.5 | 0 | A.A. 8.0 | 13,500 | 27,000 | 1 | 43.5 61.5 |
| YE | 4,000 | 6,000 | 45 | 0 | 0 | 6,500 | 13,500 | 1 | 50.0 |
| YF | 6,000 | 13,000 | 43 | 0 | 0 | 17,000 | 37,000 | 1 | 43 77 |

M.M.B.: Monobutyl maleate
A.A.: Acrylic acid

Comparative Resin Preparation Examples 7 & 8

TABLE 14

| | Comparative Resin Preparation Example | |
|---|---|---|
| | 7 | 8 |
| Styrene | 290 parts | 270 parts |
| n-Butyl methacrylate | 280 parts | 300 parts |
| Acrylic acid | 30 parts | 30 parts |
| Benzoyl peroxide | 10 parts | 5 parts |
| Toluene | 500 parts | 500 parts |

Using the materials for Comparative Resin Preparation Examples 7 and 8 as shown in the above Table 14, commonly known solution polymerization was carried out to give random copolymer yg with Mn of 11,000, Mw of 27,000 and Tg of 60° C. and random copolymer yh with Mn of 23,500, Mw of 79,000 and Tg of 61° C., respectively.

The random copolymer yg thus obtained is designated as resin YG, and the random copolymer yh as resin YH.

Example 21

| | |
|---|---|
| Resin YA of Resin Preparation Example 19 | 100 parts |
| Chromium complex of di-tert-butylsalicylic acid | 4.0 parts |
| Copper phthalocyanine pigment having the structure represented by the structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 125° C. to 225° C.

Using the above two-component developer, image reproduction was tested with use of CLC-500.

As a result, no offset to the fixing roller occurred at all even after running on 10,000 sheets in the monochromatic mode, and full-color images free from fogging and width reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Example 22

A two-component developer was prepared in the same manner as in Example 21 except that the resin YA was replaced with resin YB. The tests were carried out in the same way.

Example 23

| | |
|---|---|
| Resin YA of Resin Preparation Example 19 | 100 parts |
| Charge control agent represented by the structural formula (2) | 2 parts |
| Carbon black (particle diameter: 60 mμ) | 3.5 parts |

A two-component developer was prepared in the same manner as in Example 21 except that the above materials were used. The tests were carried out in the same way.

Example 24, Comparative Example 7

Two-component developers were prepared in the same manner as in Example 21 except that the resin YA was replaced with resins YE and YG, respectively. The tests were carried out in the same way.

Results obtained in Examples 21 to 24 and Comparative Example 7 are shown in Table 15.

TABLE 15

| | Resin | Color mixing temperature range | Running sheet number: Offset to fixing roll | (1) | (2) | (3) | (4) |
|---|---|---|---|---|---|---|---|
| Example: | | | | | | | |
| 21 | YA | 125–225° C. | 10,000 sh.: A | A | A | A | A |
| 22 | YB | 130–230° C. | 10,000 sh.: A | A | A | A | A |
| 23 | YA | 125–225° C. | 10,000 sh.: A | — | A | — | A |
| 24 | YE | 110–180° C. | 10,000 sh.: AB | A | A | A | A |
| Comparative Example: | | | | | | | |
| 7 | YG | 160–190° C. | 2,000 sh.*: C | AB | A | AB | A |

(1): Color reproduction
(2): Transport performance
(3): Light transmission properties
(4): Blocking resistance
*Offset occurred.
Remarks:
Evaluation was made according to five rank system (A, AB, B, BC, C: from "good" to "poor").

Example 25

| | |
|---|---|
| Resin YC of Resin Preparation Example 21 | 100 parts |
| Magnetic iron oxide | 70 parts |
| Chromium complex of di-tert-butylsalicylic acid | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of negatively chargeable dry process silica powder having been made hydrophobic was added as a fluidity improver. A one-component developer was thus prepared.

Using the one-component developer thus prepared, unfixed images were obtained with use of a copier NP-270, manufactured by Canon Inc., and were tested for their fixing performance using an external fixing machine. As a result, fixing was possible in a fixing temperature range of from 120° C. to 220° C.

Using the above one-component developer and the copier, image reproduction was tested. As a result, no offset to the fixing roller occurred at all even after running on 10,000 sheets, and good images free from fogging and black spots around line images were obtained.

Blocking resistance was also good similarly to that in Example 21.

Examples 26, 27, & Comparative Example 8

One-component developers were prepared in the same manner as in Example 25 except that the resin YC was replaced with resins YD, YF and YH, respectively. The tests were carried out in the same way.

Results obtained in Examples 25 to 27 and Comparative Example 8 are shown in Table 16.

TABLE 16

| | Resin | Fixing temperature range | Running sheet number: Offset to fixing roll | Fogging | Blocking resistance |
|---|---|---|---|---|---|
| Example: | | | | | |
| 25 | YC | 120–220° C. | 10,000 sh.: A | A | A |
| 26 | YD | 115–225° C. | 10,000 sh.: A | A | A |
| 27 | YF | 140–190° C. | 10,000 sh.: AB | AB | AB |
| Comparative Example: | | | | | |
| 8 | YH | 165–190° C. | 3,000 sh.: C | AB | A |

Resin Preparation Example 25

First-stage Polymerization

| | |
|---|---|
| Styrene | 400 parts |
| n-Butyl acrylate | 200 parts |
| Polymerization initiator represented by the following structural formula (I) | 54 parts |
| Formula (I) | |

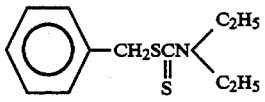

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl acrylate copolymer (Tg: 32° C.) with a number average molecular weight (Mn) of 2,000 and a weight average molecular weight (Mw) of 4,100 was obtained.

Second-stage Polymerization

In the reaction vessel after the first-stage polymerization, 1,020 parts by weight of styrene, 180 parts by weight of n-butyl acrylate and 1,500 parts by weight of toluene Were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 600 parts |
| Styrene | 1,020 parts |
| n-Butyl acrylate | 180 parts |
| Toluene | 2,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 5,800, Mw was 10,500 and Tg was 53.5° C. The AB-type block copolymer obtained here is designated as resin YI.

Resin Preparation Examples 26 to 30

Resins YJ, YK, YL, YM and YN were prepared in the same manner as in Resin Preparation Example 25 except for changing monomer compositional proportions and reaction conditions.

Properties of resins YI to YN are shown in Table 17.

TABLE 17

| | First-stage polymer | | | (AB)n-type block copolymer | | | |
|---|---|---|---|---|---|---|---|
| | Molecular weight | | Tg | Molecular weight | | | Tg |
| Resin | Mn | Mw | (°C.) | Mn | Mw | n | (°C.) |
| YI | 2,000 | 4,000 | 32 | 5,800 | 10,500 | 1 | 53.5 |
| YJ | 2,500 | 5,200 | 35 | 6,100 | 12,100 | 1 | 56.0 |
| YK | 5,000 | 12,000 | 40 | 18,000 | 45,000 | 1 | 65.0 |
| YL | 6,500 | 14,000 | 54.5 | 20,000 | 50,000 | 1 | 54.5<br>70.0 |
| YM | 3,000 | 6,800 | 35 | 7,000 | 13,000 | 1 | 45.0 |
| YN | 7,000 | 15,500 | 50 | 22,000 | 48,000 | 1 | 86.0 |

Comparative Resin Preparation Examples 9 & 10

TABLE 18

| | Comparative Resin Preparation Example | |
|---|---|---|
| | 9 | 10 |
| Styrene | 375 parts | 400 parts |
| n-Butyl acrylate | 125 parts | 100 parts |
| Benzoyl peroxide | 10 parts | 5 parts |
| Toluene | 500 parts | 500 parts |

Using the materials for Comparative Resin Preparation Examples 9 and 10 as shown in the above Table 18, commonly known solution polymerization was carried out to give random copolymer yo with Mn of 14,000, Mw of 32,000 and Tg of 55.5° C. and random copolymer yp with Mn of 25,000, Mw of 80,000 and Tg of 55° C., respectively.

The random copolymer yo thus obtained is designated as resin YO, and the random copolymer yp as resin YP.

Example 28

| | |
|---|---|
| Resin YI of Resin Preparation Example 25 | 100 parts |
| Chromium complex of di-tert-butylsalicylic acid | 4.0 parts |
| Copper phthalocyanine pigment having the structure represented by the structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 120° C. to 200° C.

Using the above two-component developer, image. reproduction was tested with use of CLC-500.

As a result, no offset to the fixing roller occurred at all even after running on 10,000 sheets in the monochromatic mode, and full-color images free from fogging and with reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Examples 29, 30, & Comparative Example 9

Two-component developers were prepared in the same manner as in Example 28 except that the resin YI was replaced with resins YJ, YM and YO, respectively. The tests were carried out in the same way.

Results obtained in Examples 28 to 30 and Comparative Example 9 are shown in Table 19.

TABLE 19

| | Resin | Color mixing temperature range | Running sheet number: Offset to fixing roll | (1) | (2) | (3) | (4) |
|---|---|---|---|---|---|---|---|
| Example: | | | | | | | |
| 28 | YI | 120–200° C. | 10,000 sh.: A | A | A | A | A |
| 29 | YJ | 130–210° C. | 10,000 sh.: A | A | A | A | A |
| 30 | YM | 110–180° C. | 10,000 sh.: AB | A | B | A | B |
| Comparative Example: | | | | | | | |
| 9 | YO | 150–170° C. | 4,000 sh.*: C | AB | A | AB | A |

(1): Color reproduction
(2): Transport performance
(3): Light transmission properties
(4): Blocking resistance
*Offset occurred.
Remarks:
Evaluation was made according to five rank system (A, AB, B, BC, C: from "good" to "Poor").

Example 31

| | |
|---|---|
| Resin YK of Resin Preparation Example 27 | 100 parts |
| Magnetic iron oxide | 70 parts |
| Nigrosine | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was added as a fluidity improver. A one-component developer was thus prepared.

Using the one-component developer thus prepared, unfixed images were obtained with use of a copier NP-4835, manufactured by Canon Inc., and were tested for their fixing performance using an external fixing machine. As a result, fixing was possible in a fixing temperature range of from 125° C. to 215° C.

Using the above one-component developer and the copier, image reproduction was tested. As a result, no offset to the fixing roller occurred at all even after running on 10,000 sheets, and good images free from fogging and black spots around line images were obtained.

Blocking resistance was also good similarly to that in Example 28.

Examples 32,and Comparative Examples 10 and 33

One-component developers were prepared in the same manner as in Example 31 except that the resin YK was replaced with resins YL, YN and YP, respectively. The tests were carried out in the same way.

Results obtained in Examples 31 to 32 and Comparative Example 10 and 33 are shown in Table 20.

TABLE 20

| Resin | | Fixing temperature range | Running sheet number: Offset to fixing roll | Fogging | Blocking resistance |
|---|---|---|---|---|---|
| Example: | | | | | |
| 31 | YK | 125–215° C. | 10,000sh.:A | A | A |
| 32 | YL | 125–220° C. | 10,000sh.:A | A | A |
| Comparative Example: | | | | | |
| 10 | YP | 155–185° C. | 1,000sh.:C | AB | A |
| 33 | YN | 150–210° C. | 10,000sh.:AB | B | A |

Resin Preparation Example 31

First-stage Polymerization

| | |
|---|---|
| Styrene | 240 parts |
| n-Butyl methacrylate | 360 parts |
| Polymerization initiator represented by the following structural formula (I) | 50 parts |
| Formula (I) | |

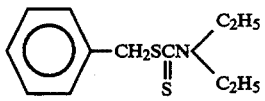

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl methacrylate copolymer (Tg: 34° C.) with a number average molecular weight (Mn) of 2,200 and a weight average molecular weight (Mw) of 4,900 was obtained.

Second-stage Polymerization

In the reaction vessel after the first-stage polymerization, 720 parts by weight of styrene, 480 parts by weight of n-butyl methacrylate and 1,500 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Styrene/n-butyl methacrylate copolymer produced in the first stage | 600 parts |
| Styrene | 720 parts |
| n-Butyl methacrylate | 480 parts |
| Toluene | 2,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,500, Mw was 13,500 and Tg was 55° C. The AB-type block copolymer obtained here is designated as resin YP-1 YP.

Resin Preparation Examples 32 to 35

Resins YQ-1, YR-1, YS-1 and YT-1 were prepared in the same manner as in Resin Preparation Example 31 except for changing monomer compositional proportions and reaction conditions.

Properties of resins YP-1 to YT-1 are shown in Table 21.

TABLE 21

| | First-stage polymer Molecular weight | | | AB-type block copolymer Molecular weight | | |
|---|---|---|---|---|---|---|
| Resin | Mn | Mw | Tg (°C.) | Mn | Mw | Tg (°C.) |
| YP-1 | 2,200 | 4,900 | 34 | 6,500 | 13,500 | 55 |
| YQ-1 | 2,100 | 4,700 | 40 | 6,200 | 11,000 | 60 |
| YR-1 | 6,500 | 13,000 | 40 | 16,000 | 40,000 | 61 |
| YS-1 | 5,000 | 14,000 | 46.5 | 12,000 | 36,000 | 63 |
| YT-1 | 2,500 | 5,300 | 20 | 6,000 | 12,000 | 39.0 |

Comparative Resin Preparation Examples 11 & 12

TABLE 22

| | Comparative Resin Preparation Example | |
|---|---|---|
| | 11 | 12 |
| Styrene | 320 parts | 300 parts |
| n-Butyl methacrylate | 280 parts | 300 parts |
| Benzoyl peroxide | 10 parts | 5 parts |
| Toluene | 500 parts | 500 parts |

Using the materials for Comparative Resin Preparation Examples 11 and 12 as shown in the above Table 22, commonly known solution polymerization was carried out to give random copolymer Yu-1 with Mn of 12,500, Mw of 31,000 and Tg of 58° C. and random copolymer Yv-1 with Mn of 20,000, Mw of 72,000 and Tg of 60° C., respectively.

The random copolymer Yu-1 thus obtained is designated as resin YU-1, and the random copolymer yv as resin YV-1.

Example 34

| | |
|---|---|
| Resin YP-1 of Resin Preparation Example 31 | 100 parts |
| Chromium complex of di-tert-butylsalicyclic acid | 4.0 parts |
| Copper phthalocyanine pigment having the structure represented by the structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 125° C. to 220° C.

Using the above two-component developer, image reproduction was tested with use of CLC-500.

As a result, no offset to the fixing roller occurred at all even after running on 10,000 sheets in the monochromatic mode, and full-color images free from fogging and with reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Example 35 & Comparative Examples 11 and 36.

Two-component developers were prepared in the same manner as in Example 34 except that the resin YP-1 was replaced with resins YQ-1, YT-1 and YU-1, respectively. The tests were carried out in the same way.

Results obtained in Examples 34 and 35 and Comparative Examples 11 and 36 are shown in Table 23.

TABLE 23

| Resin | | Color mixing temperature range | Running sheet number: Offset to fixing roll | (1) | (2) | (3) | (4) |
|---|---|---|---|---|---|---|---|
| Example: | | | | | | | |
| 34 | YP-1 | 125–220° C. | 10,000sh.:A | A | A | A | A |
| 35 | YQ-1 | 135–230° C. | 10,000sh.:A | A | A | A | A |
| Comparative Example: | | | | | | | |
| 11 | YU-1 | 155–175° C. | 2,000sh.*:C | AB | A | AB | AB |
| 36 | YT-1 | 110–160° C. | 10,000sh.:B | A | B | A | B** |

(1): Color reproduction
(2): Transport performance
(3): Light transmission properties
(4): Blocking resistance
*Offset occurred.
**Blocking slightly occurred after 10,000 sheet running.
Remarks: Evaluation was made according to five rank system (A, AB, B, BC, C: from "good" to "poor").

Example 37

| | |
|---|---|
| Resin YR-1 of Resin Preparation Example 33 | 100 parts |
| Magnetic iron oxide | 70 parts |
| Nigrosine | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was added as a fluidity improver. A one-component developer was thus prepared.

Using the one-component developer thus prepared, unfixed images were obtained with use of a copier NP-4835, manufactured by Canon Inc., and were tested for their flexing performance using an external fixing machine. As a result, fixing was possible in a fixing temperature range of from 120° C. to 200° C.

Using the above one-component developer and the copier, image reproduction was tested. As a result, no offset to the fixing roller occurred at all even after running on 10,000 sheets, and good images free from fogging and black spots around line images were obtained.

Blocking resistance was also good similarly to that in Example 34.

Example 38 & Comparative Example 12

One-component developers were prepared in the same manner as in Example 37 except that the resin YR-1 was replaced with resins YS-1 and YV-1, respectively. The tests were carried out in the same way.

Results obtained in Examples 37 and 38 and Comparative Example 12 are shown in Table 24.

TABLE 24

| Resin | | Fixing temperature range | Running sheet number: Offset to fixing roll | Fogging | Blocking resistance |
|---|---|---|---|---|---|
| Example: | | | | | |
| 37 | YR-1 | 120–200° C. | 10,000sh.:A | A | A |
| 38 | YS-1 | 115–215° C. | 10,000sh.:A | A | A |
| Comparative Example: | | | | | |
| 12 | YV-1 | 165–195° C. | 5,000sh.:C | AB | A |

Resin Preparation Example 36

First-stage Polymerization

| | |
|---|---|
| Styrene | 500 parts |
| Butadiene | 60 parts |
| n-Butyl acrylate | 40 parts |
| Polymerization initiator represented by the following structural formula (I) | 60 parts |

Formula (I)

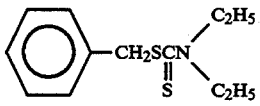

| | |
|---|---|
| Toluene | 500 parts |

The above materials were put in a reaction vessel made of glass. Its inside was thoroughly substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a styrene/n-butyl acrylate copolymer (Tg: 65° C.) with a number average molecular weight (Mn) of 3,500 and a weight average molecular weight (Mw) of 7,000 was obtained.

Second-stage Polymerization

In the reaction vessel after the first-stage polymerization, 330 parts by weight of styrene, 40 parts by weight of butadiene, 30 parts by weight of acrylic acid and 1,000 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 500 parts |
| Styrene | 330 parts |
| Butadiene | 40 parts |
| Acrylic acid | 30 parts |
| Toluene | 1,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,500, Mw was 14,000 and Tg Was 58° C. The AB-type block copolymer obtained here is designated as resin YQ.

Resin Preparation Examples 37 to 42

Resins YR, YS, YT, YU, YV and YW were prepared in the same manner as in Resin Preparation Example 36 except for changing the type and amount of the initiator monomer.

Properties Of resins YQ to YW are shown in Table 25.

TABLE 25

| | First-stage polymer | | | Amount of acid (% by weight) (based on block copolymer) | | (AB)n-type block copolymer | | | |
|---|---|---|---|---|---|---|---|---|---|
| | Molecular weight | | Tg | Segment | Segment | Molecular weight | | | Tg |
| Resin | Mn | Mw | (°C.) | A | B | Mn | Mw | n | (°C.) |
| YQ | 3,500 | 7,000 | 65 | 0 | A.A. 3.3 | 6,500 | 14,000 | 1 | 58 |
| YR | 3,500 | 6,500 | 60 | M.M.B. 6 | 0 | 6,000 | 13,000 | 1 | 56 |
| YS | 8,000 | 18,000 | 70 | A.A. 10 | A.A. 5.0 | 14,000 | 32,000 | 1 | 60 |
| YT | 8,500 | 19,000 | 72 | 0 | M.M.B. 15 | 16,000 | 33,000 | 1 | 61 |
| YU | 20,000 | 42,000 | 45 | 0 | 0 | 59,000 | 110,000 | 1 | 49 |
| YV | 16,000 | 35,000 | 70 | 0 | 0 | 20,000 | 40,500 | 1 | 70 |
| YW | 20,000 | 40,000 | — | 0 | 0 | 40,000 | 81,000 | 1 | 62 |

M.M.B.: Monobutyl maleate
A.A.: Acrylic acid

Comparative Resin Preparation Examples 13 & 14

TABLE 26

| | Comparative Resin Preparation Example | |
|---|---|---|
| | 13 | 14 |
| Styrene | 410 parts | 400 parts |
| Butadiene | 45 parts | 60 parts |
| Acrylic acid | 36 parts | 40 parts |
| Benzoyl peroxide | 10 parts | 5 parts |
| Toluene | 500 parts | 500 parts |

Using the materials for Comparative Resin Preparation Examples 13 and 14 as shown in the above Table 26, commonly known solution polymerization was carried out to give random copolymer yx with Mn of 6,800, Mw of 18,300 and Tg of 57° C. and random copolymer yy with Mn of 22,000, Mw of 67,000 and Tg of 61° C., respectively.

The random copolymer yx thus obtained is designated as resin YX, and the random copolymer yy as resin YY.

Example 39

| | |
|---|---|
| Resin YQ of Resin Preparation Example 36 | 100 parts |
| Chromium complex of di-tert-butylsalicyclic acid | 4.0 parts |
| Copper phthalocyanine pigment having the structure represented by structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 135° C. to 205° C.

Using the above two-component developer, image reproduction was tested with use of CLC-500.

As a result, no offset to the fixing roller occurred at all even after running on 10,000 sheets in the monochromatic mode, and full-color images free from fogging and with reproduction faithful to an original color chart were obtained. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Examples 40, 41, & Comparative Example 13

Two-component developers were prepared in the same manner as in Example 39 except that the resin YQ was replaced with resins YR, YU and YX, respectively. The tests were carried out in the same way.

Results obtained in Examples 39 to 41 and Comparative Example 13 are shown in Table 27.

TABLE 27

| Resin | | Color mixing temperature range | Running sheet number: Offset to fixing roll | (1) | (2) | (3) | (4) |
|---|---|---|---|---|---|---|---|
| Example: | | | | | | | |
| 39 | YQ | 135–205° C. | 10,000sh.:A | A | A | A | A |
| 40 | YR | 130–200° C. | 10,000sh.:A | A | A | A | A |
| 41 | YU | 110–180° C. | 10,000sh.:AB | A | AB | A | AB |
| Comparative Example: | | | | | | | |
| 13 | YX | 155–175° C. | 2,000sh.*:C | AB | A | AB | A |

(1): Color reproduction
(2): Transport performance, or fluidity
(3): Light transmission properties
(4): Blocking resistance
*Offset occurred.
Remarks: Evaluation was made according to five rank system (A, AB, B, BC, C: from "good" to "poor").

Example 42

| | |
|---|---|
| Resin YS of Resin Preparation Example 38 | 100 parts |
| Magnetic iron oxide | 70 parts |
| Nigrosine | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was added as a fluidity improver. A one-component developer was thus prepared.

Using the One-component developer thus prepared, unfixed images were obtained with use of a copier NP-4835, manufactured by Canon Inc., and were tested for their fixing performance using an external fixing machine. As a result, fixing was possible in a fixing temperature range of from 135° C. to 215° C.

Using the above one-component developer and the copier, image reproduction was tested. As a result, no offset to the fixing roller occurred at all even after running on 100,000 sheets, and good images free from fogging and black spots around line images were obtained.

Blocking resistance was also good similarly to that in Example 39.

Examples 43, 44, 45, & Comparative Example 14

One-component developers were prepared in the same manner as in Example 42 except that the resin YS was replaced with resins YT, YV, YW and YY, respectively. The tests were carried out in the same way.

Results obtained in Examples 42 to 45 and Comparative Example 14 are shown in Table 28.

TABLE 28

| | Resin | Fixing temperature range | Running sheet number: Offset to fixing roll | Fogging | Blocking resistance |
|---|---|---|---|---|---|
| Example: | | | | | |
| 42 | YS | 135–215° C. | 100,000 sh.: A | A | A |
| 43 | YT | 135–210° C. | 100,000 sh.: A | A | A |
| 44 | YV | 150–200° C. | 100,000 sh.: AB | B | A |
| 45 | YW | 160–240° C. | 100,000 sh.: AB | AB | A** |
| Comparative Example: | | | | | |
| 14 | YY | 165–195° C. | 2,000 sh.: C | AB | A |

**Fixing performance was slightly lowered in an environment of low temperature.

Resin Preparation Example 43

First-stage Polymerization

| | |
|---|---|
| Styrene | 370 parts |
| n-Butyl acrylate | 200 parts |
| Acrylic acid | 30 parts |
| Polymerization initiator represented by the following structural formula (I) | 60 parts |

Formula (I)

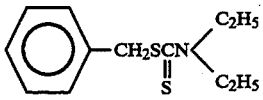

| | |
|---|---|
| Toluene | 500 parts |

The above materials were put in a reaction vessel made of glass. Its inside was thoroughly. substituted with nitrogen, and then the reaction vessel was hermetically stoppered. A 400 W ultraviolet lamp was placed at a position 15 cm distant from the reaction vessel to carry out polymerization reaction for 15 hours.

After the reaction was completed, part of the reaction product was collected, and its molecular weight was measured by gel permeation chromatography (GPC) to reveal that a copolymer with a number average molecular weight (Mn) of 2,300 and a weight average molecular weight (Mw) of 5,300 was obtained.

Second-stage Polymerization

In the reaction vessel after the first-stage polymerization, 465 parts by weight of styrene, 90 parts by weight of n-butyl acrylate, 45 parts by weight of acrylic acid and 1,000 parts by weight of toluene were added. The copolymer in the reaction vessel, obtained in the first-stage polymerization, has at its one terminal a radical generated as a result of the irradiation with ultraviolet rays, and hence a second-stage polymerization for producing an AB-type block copolymer can be carried out without second addition of a polymerization initiator. The composition of the product in the reaction vessel is shown below.

| | |
|---|---|
| Copolymer produced in the first stage | 300 parts |
| Styrene | 465 parts |
| n-Butyl acrylate | 90 parts |
| Acrylic acid | 45 parts |
| Toluene | 1,000 parts |

These materials were mixed and melted, followed by irradiation with ultraviolet rays for 15 hours under the same conditions as in the first stage to carry out the second-stage polymerization. An AB-type block copolymer was thus obtained.

After the reaction was completed, this AB-type block copolymer was reprecipitated using hexane to effect purification, followed by drying under reduced pressure. Molecular weight of this copolymer was measured by GPC to reveal that its Mn was 6,100, Mw was 12,500 and Tg was 55° C. The AB-type block copolymer obtained here is designated as resin XA.

Resin Preparation Examples 44 to 49

Resins XB, XC, XD, XE, XF and XG were prepared in the same manner as in Resin Preparation Example 43 except for changing monomer compositional proportions and reaction conditions.

Properties of resins XA to XG are shown in Table 29.

TABLE 29

| | Amount of acrylic acid (based on block copolymer) (wt. %) | | (AB) n-type block copolymer | | | |
|---|---|---|---|---|---|---|
| | Segment | Segment | Molecular weight | | | Tg |
| Resin | A | B | Mn | Mw | n | (°C.) |
| XA | 1.5 | 5.0 | 6,100 | 12,500 | 1 | 55.0 |
| XB | 7.5 | 0 | 6,400 | 13,000 | 1 | 56.5 |
| XC | 5.0 | 5.0 | 13,000 | 27,000 | 1 | 61.2 |
| XD | 0 | 2.0 | 16,000 | 35,000 | 1 | 47.5<br>60.0 |
| XE | 0 | 0 | 7,000 | 15,000 | 1 | 45.0 |
| XF | 0 | 0 | 16,000 | 33,000 | 1 | 45<br>70 |
| XG | 0 | 0 | 42,000 | 89,000 | 4 | 65.0 |

Comparative Resin Preparation Examples 15 & 16

TABLE 30

| | Comparative Resin Preparation Example | |
|---|---|---|
| | 15 | 16 |
| Styrene | 468 parts | 450 parts |
| n-Butyl acrylate | 102 parts | 120 parts |
| Acrylic acid | 30 parts | 30 parts |
| Benzoyl peroxide | 10 parts | 5 parts |
| Toluene | 500 parts | 500 parts |

Using the materials for Comparative Resin Preparation Examples 15 and 16 as shown in the above Table 30, commonly known solution polymerization was carried out to give random copolymer xh with Mn of 11,000, Mw of 26,000 and Tg of 57.5° C. and random copolymer xi with Mn of 23,500, Mw of 28,000 and Tg of 60° C., respectively;

The random copolymer xh thus obtained is designated as resin XH, and the random copolymer xi as resin XI.

Example 46

| | |
|---|---|
| Resin XA of Resin Preparation Example 43 | 100 parts |
| Phthalocyanine pigment | 5 parts |
| Chromium complex of di-tert-butylsalicylic acid | 4 parts |

The above materials were thoroughly premixed using a Henschel mixer, and the mixture was melt-kneaded at least twice using a three-roll mill. After cooled, the kneaded product was crushed using a hammer mill to have particle diameters of approximately from 1 to 2 mm, and then pulverized using a fine grinding mill of an air-jet system. The finely ground product thus obtained was classified, and particles with particle diameters of from 2 to 10 μm were selected so as to give the preferable particle size distribution of the present invention. A blue toner was thus obtained. This blue toner had the following particle size distribution.

| | |
|---|---|
| Weight average particle diameter: | 8.2 μm |
| Particles of 5 μm or smaller: | 29% by number |
| Particles of from 12.7 to 16 μm: | 1.8% by volume |
| Particles of 16 μm or larger: | substantially 0% |
| Particles of $\frac{V \times \bar{dv}}{N} = \frac{64 \times 8.0}{46} = 11.1$ | |

Next, 100 parts by weight of fine silica powder with a specific surface area of 200 $m^2/g$, AEROSIL #200 (trade name, available from Nippon Aerosil Co., Ltd.) was treated with 20 parts by weight of hexamethyldisilazane (HMDS) and also thereafter treated with a solution prepared by diluting 10 parts by weight of dimethylsilicone oil KF-96 (trade name, Shin-Etsu Chemical Co., Ltd.) of 100 cSt. After dried, the treated powder was heated at 250° C. Thus a fine silica powder treated with hexamethyldisilazane and further treated with dimethylsilicone oil was obtained. This powder, in an amount of 0.4 part by weight, was externally added to 100 parts by weight of the aforesaid blue toner.

To 5 parts by weight of the above blue toner containing external additives, a carrier comprising a Cu—Zn—Fe ferrite carrier with a weight average particle diameter of 45 μm having particle size distribution of particles of 35 μm or smaller: 4.2%, 35 to 40 μm: 9.5% and 34 μm or larger: 0.2%, and coated with a copolymer comprised of 50% of styrene, 20% of methyl methacrylate and 30% of 2-ethylhexyl acrylate, was mixed so as to be in a total amount of 100 parts by weight. A two-component developer was thus prepared.

Using the two-component developer thus prepared, images were reproduced on a commercially available plain-paper color copier (COLOR LASER COPIA 500, trade name, manufactured by Canon Inc.) the charging assembly of which was so modified as to have the constitution shown in FIG. 3. In the fixing assembly shown in FIG. 3, the charging roller 102 was 12 mmϕ in outer diameter, the conductive rubber layer **102*b* was made of EPDM, and the surface layer 102*c* was formed of a nylon resin in a thickness of 10 μm. The charging roller 102*c*** was made to have a hardness of 54.5° C. (ASKER-C).

Development contrast was adjusted by controlling applied voltages as follows:

| | |
|---|---|
| 270 V: | In an environment of 23° C./65% RH |
| 330 V: | In an environment of 20° C./10% RH |
| 250 V: | In an environment of 30° C./80% RH |

As a result, images obtained in each environment had an image density of as stable as from 1.45 to 1.55, and were clear image with no fogging at all. Faulty cleaning did not occur, and also there was no lowering of charge efficiency.

No offset to the fixing roller occurred at all even after running on 10,000 sheets in the monochromatic mode. Also when an OHP film was used, the transparency of toner was in a very preferable state.

The developer was left to stand for a day in a hot-air dryer of 45° C. to examine the state of blocking of toner to confirm that no changes were seen at all, showing a good fluidity.

Unfixed images obtained only by development and transfer with Use of a modified machine of a full-color copier CLC-500, manufactured by Canon Inc., were tested for their fixing performance using an external fixing machine. AS a result, color mixture was possible in a fixing temperature range of as broad as from 120° C. to 215° G.

Examples 47, 48, & Comparative Example 15

Two-component developers were prepared in the same manner as in Example 46 except that the resin XA was replaced with resins XB, XE and XH, respectively. The tests were carried out in the same way.

Results obtained in Examples 46 to 48 and Comparative Example 15 are shown in Table 31.

TABLE 31

| | Resin | Color mixing temperature range | Running sheet number: Offset to fixing roller | Color reproduction | Transport performance | Light transmission properties | Blocking resistance | Image density |
|---|---|---|---|---|---|---|---|---|
| Example 46 | XA | 120–215° C. | 10,000 sheets: A | A | A | A | A | 1.45–1.55 |
| Example 47 | XB | 120–220° C. | 10,000 sheets: A | A | A | A | A | 1.45–1.55 |
| Example 48 | XE | 110–170° C. | 10,000 sheets: AB | A | AB | A | AB | 1.45–1.55 |
| Comparative Example 15 | XH | 150–170° C. | 2,000 sheets: Offset occurred. | AB | AB | AB | AB | 1.35–1.50<br>1.10–1.30 |

Remarks:
Evaluation was made according to five rank system (A, AB, B, BC, C: from "good" to "Poor").

Example 49

Example 46 was repeated except that in the charging assembly used therein the surface layer 102c was made of PVDF resin. Good results were obtained.

Example 50

Images were reproduced in the same manner as in Example 46 except that the charging assembly used therein was so modified as to be constituted as shown in FIG. 5. Good results were obtained. In a 20,000 sheet running test, the charge efficiency was only slightly lowered, and no filming to the photosensitive member occurred.

Example 51

Images were reproduced in the same manner as in Example 46 except that the charging assembly used therein was not provided with the surface layer 102c. As a result, melt adhesion of toner to the photosensitive member slightly occurred. This is presumably due to the softening agent in the rubber of the charging roller.

Example 52

Images were reproduced in the same manner as in Example 46 except that a fine silica powder was used whose particle surfaces were treated with hexamethyldisilazane as in Example 46 but thereafter not treated with dimethylsilicone oil. As a result, fogging slightly occurred on images in an environment of high temperature and high humidity. When the running test was further continued, toner scatter in the machine began to occur.

Example 53

| | |
|---|---|
| Resin XC of Resin Preparation Example 45 | 100 parts |
| Quinacridone type magenta pigment | 5.0 parts |
| Chromium complex of di-tert-butylsalicylic acid | 4.0 parts |

Using the above materials, a red toner was obtained. This red toner had the following particle size distribution.

| | |
|---|---|
| Weight average particle diameter: | 8.2 μm |
| Particles of 5 μm or smaller: | 28% by number |
| Particles of from 12.7 to 16 μm: | 2.2% by volume |
| Particles of 16 μm or larger: | substantially 0% |
| Particles of $\frac{V \times \bar{dv}}{N} = \frac{64 \times 8.2}{42} = 12.1$ | |

To 100 parts by weight of the above red toner 0.5 part by weight of a fine silica powder treated with γ-aminopropyltrimethoxysilane and thereafter further treated with methylhydrogensilicone oil (trade name: TSF484; available from Toshiba Silicone Co., Ltd.) was externally added. A one-component developer was thus prepared.

Using the above one-component developer, images were reproduced in the same manner as in Example 46. As a result, sharp images with a stable image density (1.35 to 1.50) were obtained in both an environment of high temperature and high humidity and an environment of low temperature and low humidity. No problem was caused at all even in a 10,000 sheet running test.

Examples 54 to 57 & Comparative Example 16

One-component developers were prepared in the same manner as in Example 53 except that the resin XC was replaced with resins XD, XE, XF, XG and XI, respectively. The tests were carried out in the same way.

Results obtained in Examples 53 to 57 and Comparative Example 16 are shown in Table 32.

TABLE 32

| | Resin | Fixing temperature range | Running sheet number: Offset to fixing roll | (1) | (2) | Image density |
|---|---|---|---|---|---|---|
| Example: | | | | | | |
| 53 | XC | 125–230° C. | 100,000 sh.: A | A | A | 1.35–1.50 |
| 54 | XD | 115–225° C. | 100,000 sh.: A | A | A | 1.35–1.50 |
| 55 | XF | 115–200° C. | 100,000 sh.: AB | AB | A | 1.35–1.50 |
| 56 | XG | 130–200° C. | 100,000 sh.: AB | AB | A | 1.35–1.50 |
| Compar- | | | | | | |

TABLE 32-continued

| | Resin | Fixing temperature range | Running sheet number: Offset to fixing roll | (1) | (2) | Image density |
|---|---|---|---|---|---|---|
| ative Example: | | | | | | |
| 16 | XI | 165–195° C. | 3,000 sh.: C | BC | A | 1.10–1.30 |

(1): Fogging
(2): Blocking resistance

Example 57

| | |
|---|---|
| Resin XA of Resin Preparation Example 43 | 100 parts |
| Chromium complex of di-tert-butylsalicylic acid | 4.0 parts |
| Copper phthalocyanine pigment having the structure represented by the structural formula (1) | 5.0 parts |

The above materials were melt-kneaded using a roll mill, and the kneaded product was cooled, followed by crushing, pulverizing and classification to give a blue toner. Based on 100 parts by weight of the resulting blue toner, 0.5 part by weight of fine silica powder treated with hexamethyldisilazane, serving as a fluidity improver, and 0.2 part by weight of fine aluminum oxide powder were added and mixed.

As a carrier, a Cu—Zn—Fe ferrite carrier (average particle diameter: 45 μm; 250 mesh-pass 400 mesh-on: 87% by weight) coated with 0.5% by weight of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight A two-component developer was thus prepared.

Using the two-component developer thus prepared, unfixed images were obtained only by development and transfer with use of a full-color copier CLC-500, manufactured by Canon Inc., and were tested for their fixing performance using an external fixing machine.

As a result , color mixture was possible in a fixing temperature range of from 120° C. to 215° C.

Using the above two-component developer, a running test was carried out with use of CLC-500.

In the running test, the fixing apparatus as shown in FIG. 6, provided with the fixing roller comprised of the first elastic layer, oil-resistent layer and anti-offset layer having a rubber elongation of 250%, 300% and 500%, respectively.

As a result, no offset to the fixing roller occurred at all even after running on 10,000 sheets in the monochromatic mode, and full-color images free from fogging and with reproduction faithful to an original color chart were obtained. The running test was further carried out on 40,000 sheets to have confirmed that no separation of layers nor offset occurred. Transport performance of toner in the copying machine was good, and a stable image density was obtained.

When an OHP film was used, the transparency of toner was in a very preferable state.

The developer was left to stand for a day in a hot-air dryer of 45° C. to examine the state of blocking of toner to confirm that no changes were seen at all, showing a good fluidity.

Examples 58, 59, & Comparative Example 17

Two-component developers were prepared in the same manner as in Example 57 except that the resin XA was replaced with resins XB, XE and XH, respectively. The tests were carried out in the same way.

Results obtained in Examples 57 to 59 and Comparative Example 17 are shown in Table 33.

TABLE 33

| | Resin | Color mixing temperature range | Running sheet number: Offset to fixing roll | (1) | (2) | (3) | (4) |
|---|---|---|---|---|---|---|---|
| Example: | | | | | | | |
| 57 | XA | 120–215° C. | 50,000 sh.: A | A | A | A | A |
| 58 | XB | 120–220° C. | 50,000 sh.: A | A | A | A | A |
| 59 | XE | 110–170° C. | 50,000 sh.: AB | A | AB | A | AB |
| Comparative Example: | | | | | | | |
| 17 | XH | 150–170°C. | 2,000 sh.*: C | AB | A | AB | A |

(1): Color reproduction
(2): Transport performance
(3): Light transmission properties
(4): Blocking resistance
*Offset occurred.
Remarks:
Evaluation was made according to five rank system (A, AB, B, BC, C: from "good" to "poor").

Example 60

| | |
|---|---|
| Resin XC of Resin Preparation Example 45 | 100 parts |
| Quinacridone pigment | 5.0 parts |
| Chromium complex of di-tert-butylsalicylic acid | 2.0 parts |

The above materials were melt-kneaded using a roll mill, and the kneaded product was cooled, followed by crushing, pulverizing and classification to give a red toner. Based on 100 parts by weight of the resulting red toner, 0.2 part by weight of fine silica powder and 0.5 part by weight of fine aluminum oxide powder were added and mixed.

Then, a fixing test was carried out in the same manner as in Example 59. As a result, fixing was possible in a fixing temperature range of from 125° C. to 230° C. No offset to the fixing roller occurred at all even when a 50,000 sheet running test was carried out using CLC-500 in the monochromatic mode, and good image free from fogging and black spots around line images were obtained. Blocking resistance was also confirmed in the same manner as in Example 59 to obtain good results.

Examples 61, 62and 63 & Comparative Example 18

One-component developers were prepared in the same manner as in Example 60 except that the resin XC was replaced with resins XD, XF, XG, and XI, respectively. The tests were carried out in the same way.

Results obtained in Examples 60 to 63 and Comparative Example 18 are shown in Table 34.

TABLE 34

| | Resin | Color mixing temperature range | Running sheet number: Offset to fixing roll | (1) | (2) | (3) | (4) |
|---|---|---|---|---|---|---|---|
| Example: | | | | | | | |
| 60 | XC | 125–230° C. | 50,000 sh.: A | A | A | A | A |
| 61 | XD | 115–225° C. | 50,000 sh.: A | A | A | A | A |
| Comparative Example: | | | | | | | |
| 18 | XG | 185–205° C. | 50,000 sh.: AB | A | AB | A | AB |
| 62 | XF | 120–140° C. | 50,000 sh.: AB | A | AB | A | AB |

(1): Color reproduction
(2): Transport performance
(3): Light transmission properties
(4): Blocking resistance
Remarks:
Evaluation was made according to five rank system (A, AB, B, BC, C: from "good" to "poor").

Comparative Example 19

A running test was carried out in the same manner as in Example 57 except that the fixing roller as shown in FIG. 6 was replaced with a fixing roller comprised of a first elastic layer, an oil-resistent layer and an anti-offset layer having a rubber elongation of 300%, 250% and 200%, respectively. As a result, separation of the layers occurred before completion of 10,000 sheet running, and hence the running test was stopped halfway.

Comparative Example 20

A running test was carried out in the same manner as in Example 57 except that the fixing roller as shown in FIG. 6 was replaced with a fixing roller comprised of a first elastic layer, an oil-resistent layer and an anti-offset layer having a rubber elongation of 250%, 300% and 250% respectively As a result, separation of layers occurred between the anti-offset layer and the oil-resistent layer during the running test, and hence the test was also stopped halfway.

We claim:

1. A developer for developing an electrostatic image, comprising:

a toner containing a binder resin and a colorant, said binder resin being comprised of an AB-type block copolymer having segment-A and segment-B;

said segment-A having a copolymer structure comprised of a styrene monomer and at least one monomer selected from the group consisting of an acrylic monomer, a methacrylic monomer and a diene monomer, and said segment-B having a copolymer structure comprised of a styrene monomer and at least one monomer selected from the group consisting of an acrylic monomer, a methacrylic monomer and a diene monomer, provided that said segment-A and segment-B have copolymer structures different from each other, wherein (i) a glass transition point (Tg) of said AB-type block copolymer is higher than a glass transition point ($Tg_B$) of said segment-B and said glass transition point (Tg) of said AB-type block copolymer satisfies the following relationship:

$$40° C. \leqq (Tg) \leqq 85° C.$$

when said AB-type block copolymer has one glass transition point (Tg, or (ii) a glass transition point ($Tg_A$) of said segment-A is higher than said glass transition point ($Tg_B$) of said segment-B and said glass transition points ($Tg_A$) and ($Tg_B$) of said AB-type block copolymer satisfies the following relationship:

$$25° C. \leqq (Tg_B) < (Tg_A) \leqq 90° C.$$

when said AB-type block copolymer has different glass transition points ($Tg_A$) and ($Tg_B$).

2. The developer according to claim 1, wherein said developer is a one-component developer comprising the toner.

3. The developer according to claim 2, wherein said AB-type block copolymer has a number average molecular weight Mn of from 2,500 to 40,000 and a weight average molecular weight Mw of from 20,000 to 500,000.

4. The developer according to claim 2, wherein said AB-type block copolymer has a number average molecular weight Mn of from 3,500 to 20,000 and a weight average molecular weight Mw of from 35,000 to 350,000.

5. The developer according to claim 2, wherein said AB-type block copolymer comprises an (AB)n-type block copolymer in which n is from 1 to 15.

6. The developer according to claim 2, wherein said toner is a magnetic toner containing a magnetic material.

7. The developer according to claim 6, wherein said magnetic toner contains a magnetic material in an amount of from 15% by weight to 70% by weight on the basis of the toner.

8. The developer according to claim 1, wherein said developer is a two-component developer comprising a carrier and the toner.

9. The developer according to claim 8 wherein said carrier has a resin coat layer on its particle surfaces.

10. The developer according to claim 8, wherein said developer is a developer for full-color electrophotography.

11. The developer according to claim 10, wherein said AB-type block copolymer has a number average molecular weight Mn of from 1,500 to 30,000 and a weight average molecular weight Mw of from 4,000 to 50,000.

12. The developer according to claim 10, wherein said AB-type block copolymer has a number average molecular weight Mn of from 2,000 to 20,000 and a weight average molecular weight Mw of from 6,000 to 35,000.

13. The developer according to claim 10, wherein said AB-type block copolymer comprises an (AB)n-type block copolymer in which n is from 1 to 10.

14. The developer according to claim 8, wherein said developer is a developer for monochromatic electrophotography.

15. The developer according to claim 14, wherein said AB-type block copolymer has a number average molecular weight Mn of from 2,500 to 40,000 and a weight average molecular weight Mw of from 20,000 to 500,000.

16. The developer according to claim 14, wherein said AB-type block copolymer has a number average molecular weight Mn of from 3,500 to 20,000 and a weight average molecular weight Mw of from 35,000 to 350,000.

17. The developer according to claim 14, wherein said AB-type block copolymer comprises an (AB)n-type block copolymer in which n is from 1 to 15.

18. The developer according to claim 1, wherein said segment-A of said AB-type block copolymer has a copolymer structure comprised of a styrene monomer and a methacrylic monomer, and said segment-B thereof has a copolymer structure comprised of a styrene monomer and an acrylic monomer.

19. The developer according to claim 1, wherein said segment-A of said AB-type block copolymer has a copolymer structure comprised of a styrene monomer and a methacrylic monomer, said segment-B thereof has a copolymer structure comprised of a styrene monomer and an acrylic monomer, and at least one of said segment-A and segment-B has a carboxyl group.

20. The developer according to claim 1, wherein said segment-A of said AB-type block copolymer has a copolymer structure comprised of a styrene monomer and an acrylic monomer, said segment-B thereof has a copolymer structure comprised of a styrene monomer and an acrylic monomer, and at least one of said segment-A and segment-B has a carboxyl group.

21. The developer according to claim 1, wherein said segment-A of said AB-type block copolymer has a copolymer structure comprised of a styrene monomer and a methacrylic monomer, said segment-B thereof has a copolymer structure comprised of a styrene monomer and a methacrylic monomer and at least one of said segment-A and segment-B has a carboxyl group.

22. The developer according to claim 1, wherein said segment-A of said AB-type block copolymer has a copolymer structure comprised of a styrene monomer and an acrylic monomer, said segment-B thereof has a copolymer structure comprised of a styrene monomer and an acrylic monomer.

23. The developer according to claim 1, wherein said segment-A of said AB-type block copolymer has a copolymer structure comprised of a styrene monomer and a methacrylic monomer, said segment-B thereof has a copolymer structure comprised of a styrene monomer and a methacrylic monomer.

24. The developer according to claim 1, wherein said segment-A of said AB-type block copolymer has a copolymer structure comprised of a styrene monomer, a diene monomer and optionally at least one monomer selected from the group consisting of an acrylic monomer and a methacrylic monomer, said segment-B thereof has a copolymer structure comprised of a styrene monomer, a diene monomer and optionally at least one monomer selected from the group consisting of an acrylic monomer and a methacrylic monomer, and said AB-type block copolymer has number average molecular weights MnB and MnA as measured by GPC, satisfying the relationship:

$$500 \leqq MnB < MnA$$

25. The developer according to claim 1, wherein said AB-type block copolymer has one glass transition point (Tg), said glass transition point (Tg) being in the range of from 45° C. to 65° C.

26. The developer according to claim 1, wherein said AB-type block copolymer has different glass transition points ($Tg_A$) and ($Tg_B$), and said glass transition points ($Tg_A$) and ($Tg_B$) of said AB-type block copolymer satisfies the following relationship:

$$40^\circ\ C. \leqq (Tg_B) < (Tg_A) \leqq 85^\circ\ C.$$

27. The developer according to claim 1, wherein said AB-type block copolymer has different glass transition points ($Tg_A$) and ($Tg_B$), and said glass transition points ($Tg_A$) and ($Tg_B$) of said AB-type block copolymer satisfies the following relationship:

$$45^\circ\ C. \leqq (Tg_B) < (Tg_A) \leqq 65^\circ\ C.$$

28. The developer according to claim 1, wherein at least one of said segment-A and segment-B of said AB-type block copolymer has a carboxyl group.

29. The developer according to claim 1, wherein said AB-type block copolymer comprises an (AB)n-type block copolymer in which n is from 1 to 20.

30. The developer according to claim 1, wherein said binder resin contains said AB-type block copolymer in an amount of not less than 30% by weight on the basis of the binder resin.

31. The developer according to claim 1, wherein said binder resin contains said AB-type block copolymer in an amount of not less than 50% by weight on the basis of the binder resin.

32. The developer according to claim 1, wherein said binder resin comprises said AB-type block copolymer and at least one polymer selected from the group consisting of a polymer comprised of a vinyl monomer containing a carboxyl group and a polymer comprised of a vinyl monomer containing no carboxyl group.

33. The developer according to claim 32, wherein at least one polymer selected from the group consisting of a polymer comprised of a vinyl monomer containing a carboxyl group and a polymer comprised of a vinyl monomer containing no carboxyl group, contained in said binder resin has a glass transition point (Tg) of from 45° C. to 70° C.

34. The developer according to claim 1, wherein said segment-A of said AB-type block copolymer has a copolymer structure comprised of a styrene monomer and an acrylic monomer in a compositional proportion of from 98:2 to 50:50 in weight ratio.

35. The developer according to claim 1, wherein said segment-B of said AB-type block copolymer has a copolymer structure comprised of a styrene monomer and an acrylic monomer in a compositional proportion of from 95:5 to 40:60 in weight ratio.

36. The developer according to claim 1, wherein said segment-A of said AB-type block copolymer has a copolymer structure comprised of a styrene monomer and a methacrylic monomer in a compositional proportion of from 95:5 to 30:70 in weight ratio.

37. The developer according to claim 1, wherein said segment-B of said AB-type block copolymer has a copolymer structure comprised of a styrene monomer and a methacrylic monomer in a compositional proportion of from 92:8 to 25:75 in weight ratio.

38. The developer according to claim 1, wherein said segment-A of said AB-type block copolymer has a copolymer structure comprised of a styrene monomer and a diene monomer in a compositional proportion of from 98:2 to 65:35 in weight ratio.

39. The developer according to claim 1, wherein said segment-B of said AB-type block copolymer has a copolymer structure comprised of a styrene monomer and a diene monomer in a compositional proportion of from 96:4 to 60:40 in weight ratio.

40. The developer according to claim 1, wherein said segment-A and segment-B of said AB-type block copolymer each have a copolymer structure comprised of a styrene monomer, a diene monomer, an acrylic monomer and a methacrylic monomer in a compositional proportion of from 98 to 60:35 to 2:30 to 0:30 to 0 in weight ratio.

41. The developer according to claim 1, wherein a vinyl monomer containing a carboxyl group is copolymerized in said AB-type block copolymer in an amount of from 0.5% by weight to 20% by weight.

42. The developer according to claim 1 wherein the colorant contained in said toner is comprised of at least one material selected from the group consisting off a dye, a pigment and a magnetic material.

43. The developer according to claim 1, wherein said toner contains said colorant in an amount of from 0.1 part by weight to 60 parts by weight based on 100 parts by weight of the binder resin.

44. The developer according to claim 1, wherein said developer contains at least one fluidity improver selected from the group consisting of a fluorine resin powder, a fatty acid metal salt, a metal oxide and a fine silica powder.

45. The developer according to claim 40, wherein said fine silica powder comprises a treated silica obtained by treating fine silica powder with an amino group-containing coupling agent or an amino group-containing silicone oil, and further treating the treated powder with an organic silicon compound to make it hydrophobic.

46. The developer according to claim 40, wherein said fine Silica powder comprises a treated silica obtained by treating fine silica powder with a silane coupling agent, and further treating the treated powder with a silicone oil.

47. The developer according to claim 1, wherein said tone has a weight average particle diameter of from 4 μm to 20 μm.

48. The developer according to claim 1, wherein said toner has a weight average particle diameter of from 6 to 10 μm, toner particles with particle diameters not larger than 5 μm are contained in an amount of from 15 to 40% by number, toner particles with particle diameters of from 12.7 to 16.0 μm are contained in an amount of from 0.1 to 5.0% by number, toner particles with particle diameters not smaller than 16 μm are contained in an amount of not more than 1.0% by weight, and toner particles with a particle diameter of from 6.35 to 10.1 μm have a particle size distribution satisfying the following expression:

$$9 \leqq V \times dv/N \leqq 14$$

wherein V represents % by weight of the toner particles with particle diameters of from 6.35 to 10.1 μm; N represents % by number of the toner particles with particle diameters of from 6.35 to 10.1 μm; and dv represents a weight average particle diameter of the whole toner particles.

49. The developer according to claim 1, wherein said AB-type block copolymer has one glass transition point (Tg), and the glass transition point (Tg) of said AB-type block copolymer is higher than the glass transition point ($Tg_B$) of said segment-B by 5° C. or more.

50. The developer according to claim 1, wherein said AB-type block copolymer has one glass transition point (Tg), and the glass transition point (Tg) of said AB-type block copolymer is higher than the glass transition point ($Tg_B$) of said segment-B by 16° C. or more.

51. The developer according to claim 1, wherein said AB-type block copolymer has different glass transition points ($Tg_A$) and ($Tg_B$), and the glass transition point ($Tg_A$) of said segment-A is higher than the glass transition point ($Tg_B$) of said segment-B by 12° C. or more.

52. The developer according to claim 1, wherein said AB-type block copolymer has a number average molecular weight (Mn) of 20,000 or less.

* * * * *

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

ON TITLE PAGE

In [56] References Cited, under U.S. PATENT DOCUMENTS:
"4,557,991 12/1985 Takasiwa et al." should read
--4,557,991 12/1985 Takagiwa et al.--.

In [56] References Cited, under FOREIGN PATENT DOCUMENTS:
"523305 7/1973 Japan" should read
--52-3305 1/1977 Japan--;
"57-6585 5/1982 Japan" should read
--57-6585 2/1982 Japan--; and
"1295269 11/1989 Japan" should read
--1-295269 11/1989 Japan.--.

COLUMN 1

Line 12, "Such" should read --such--.
Line 13, "relates" should read --relates to--.
Line 30, "met hods" should read --methods--.
Line 36, "e" should read --a--.

COLUMN 2

Line 23, "has" should be deleted.

COLUMN 4

Line 1, "so as" should read --so--.
Line 2, "for" should be deleted and "not" should read --does not--.
Line 66, "beared" should read --borne--.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 5

Line 2, "contact each" should read --contact with each--.
Line 5, "froming" should read --forming--.
Line 24, "on," should read --on--.

COLUMN 6

Line 42, "Nowadays, a" should read --A--.
Line 62, "increasing" should read --increasingly--.
Line 67, "poop" should read --poor--.

COLUMN 7

Line 15, "dif-" should be deleted.
Line 16, "ferent from each other (segment-A: TgA; segment-B:" should read --TgA and--.
Line 17, "TgB)," should read --TgB,--.
Line 49, "acts" should read --act--.

COLUMN 8

Line 59, "be" (second occurrence) should be deleted.

COLUMN 9

Line 16, "carboxy" should read --carboxyl--.

COLUMN 10

Line 15, "preferably" should read --preferably be--.
Line 22, "the" (first occurrence) should be deleted.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 10

Line 57, "isobutylvinyl" should read --isobutyl vinyl--.
Line 59, "ketone" (second occurrence) should read --ketone;--.

COLUMN 11

Line 18, "is" should read --to be--.
Line 30, "other all" should read --all other--.
Line 35, "C.I." (first occurrence) should be deleted.
Line 60, "48i" should read --48,--.

COLUMN 12

Line 4, "Red q;" should read --Red 9;--.

COLUMN 16

Line 25, "Tanging" should read --ranging--.
Line 26, "Used." should read --used.--.
Line 52, "$H_5C_2$" should read --$H_3C_2$--.

COLUMN 17

Line 4, "NHCH2CH2CH2Si(OCH3)3" should read --$NHCH_2CH_2CH_2Si(OCH_3)_3$--.

COLUMN 19

Line 49, "vinyl group" should read --vinyl group,--.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 20

Line 54, "number" should read --number,--.
Line 56, "tonex" should read --toner--.

COLUMN 21

Line 2, "aver age" should read --average--.
Line 17, "hot" should read --not--.
Line 19, "being" should read --is--.

COLUMN 22

Line 19, "and" should read --an--.
Line 30, "(dv)," should read --($\bar{d}$v)--.
Line 35, "dv" should read --$\bar{d}$v
Line 54, "(dv)," should read --($\bar{d}$v)--.
Line 59, "less" should read --small--.

COLUMN 23

Line 62, "a foresaid" should read --aforesaid--.

COLUMN 24

Line 14, "roll" should read --roll,--.
Line 23, "roll" should read --role--.
Line 25, "carried" should read --carrier--.

COLUMN 25

Line 26, "Weight" should read --weight--.
Line 44, "thins" should read --this--.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 27

Line 13, "apart" should read --part--.

COLUMN 28

Line 17, "one," should read --one--.

COLUMN 29

Line 1, "an" should read --on--.
Line 23, "top" should read --for--.

COLUMN 30

Line 12, "layers" should read --layer--.
Line 19, "Operation" should read --operation--.
Line 39, "prefer: red" should read --preferred--.

COLUMN 31

Line 22, "Colors)" should read --colors)--.
Line 28, "is" should read --are--.
Line 51, "the," should read --the--.

COLUMN 32

Line 22, "affect" should read --affects--.
Line 68, "a ;rubber" should read --a rubber--.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 33

Line 9, "Of" should read --of--.
Line 32, "lager" should read --larger--.

COLUMN 34

Line 51, "let" should be deleted.

COLUMN 38

Line 30, "Table" should read --Table 5--.

COLUMN 42

Line 30, "v" should read --V--.

COLUMN 46

Line 40, "asin" should read --as in--.

COLUMN 48

TABLE 15, "10,000 sh.:" should read --10,000 sh.: AB--.
AB

COLUMN 49

Line 65, "Were" should read --were--.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 51

TABLE 19, "10,000 sh.:" should read --10,000 sh.: AB--.
AB

COLUMN 53

Line 62, "YP-1 YP." should read --YP-1.--.

COLUMN 54

Line 32, "Yu-1" should read --yu-1--.
Line 33, "yv" should read --yv-1--.

COLUMN 59

Line 48, "One-component" should read --one-component--.

COLUMN 61

Line 66, "cooled," should read --being cooled,--.

COLUMN 62

Line 24, "dried," should read --being dried,--.
Line 62, "image" should read --images--.

COLUMN 63

Line 6, "Use" should read --use--.
Line 9, "AS" should read --As--.
Line 11, "215°G." should read --215°C.--.

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 64

Line 65, "100,000 sh.:" should read --100,000 sh.: AB--.
AB

Line 66, "100,000 sh.:" should read --100,000 sh.: AB--.
AB

COLUMN 66

Line 65, "62and" should read --62 and--.

COLUMN 67

TABLE 34, "61 XD 115-225°C. 50,000 sh.: A A A A A"

should read

| | | | | | | | | | |
|---|---|---|---|---|---|---|---|---|---|
| --61 | XD | 115-225°C. | 50,000 sh.: | A | A | A | A | A" |
| 62 | XF | 120-140°C. | 50,000 sh.: | AB | A | AB | A | AB |
| 63 | XI | 165-195°C. | 3,000 sh.: | C | AB | AB | AB | AB--. |

and "62 XF 120-140°C. 50,000 sh.: AB A AB A AB"
should be deleted.

Line 28, "oil-resistent" should read --oil-resistant--.
Line 38, "oil-resistent" should read --oil-resistant--.
Line 41, "oil-resistent" should read --oil-resistant--.

COLUMN 68

Line 2, "(Tg," should read --(Tg)--.
Line 24, "fies" should read --fy--.
Line 56, "claim 8" should read --claim 8,--.

--

UNITED STATES PATENT AND TRADEMARK OFFICE

CERTIFICATE OF CORRECTION

PATENT NO. : 5,418,102

DATED : May 23, 1995

INVENTOR(S) : TAKAAKI KOTAKI, ET AL.

It is certified that error appears in the above-identified patent and that said Letters Patent is hereby corrected as shown below:

COLUMN 70

Line 17, "fies" should read --fy--.
Line 25, "fies" should read --fy--.

COLUMN 71

Line 33, "off" should read --of--.
Line 45, "claim 40," should read --claim 44,--.

COLUMN 72

Line 3, "claim 40," should read --claim 44,--.
Line 4, "Silica" should read --silica--.

Signed and Sealed this

Ninth Day of January, 1996

Bruce Lehman

*Attest:*

BRUCE LEHMAN

*Attesting Officer*

*Commissioner of Patents and Trademarks*